US010160231B2

(12) United States Patent
Ernst et al.

(10) Patent No.: US 10,160,231 B2
(45) Date of Patent: Dec. 25, 2018

(54) PRINTING SYSTEM FOR APPAREL

(71) Applicant: NIKE, Inc., Beaverton, OR (US)

(72) Inventors: Travis K. Ernst, Portland, OR (US); Christopher Andon, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/996,485

(22) Filed: Jan. 15, 2016

(65) Prior Publication Data

US 2016/0347099 A1 Dec. 1, 2016

Related U.S. Application Data

(63) Continuation-in-part of application No. 14/723,756, filed on May 28, 2015.

(51) Int. Cl.

| | |
|---|---|
| ***B41J 2/165*** | (2006.01) |
| ***B41J 3/407*** | (2006.01) |
| ***B41J 11/04*** | (2006.01) |
| ***B41J 11/20*** | (2006.01) |

(52) U.S. Cl.

CPC ..... *B41J 3/4078* (2013.01); *B41J 3/4073* (2013.01); *B41J 11/04* (2013.01); *B41J 11/20* (2013.01)

(58) Field of Classification Search

None

See application file for complete search history.

(56) References Cited

U.S. PATENT DOCUMENTS

| | | | | |
|---|---|---|---|---|
| 2,249,939 | A | 7/1941 | Branan | |
| 4,235,101 | A | 11/1980 | Stadelmann | |
| 4,703,333 | A * | 10/1987 | Hubbard | B41J 2/14233 346/145 |
| 5,548,995 | A | 8/1996 | Clinton et al. | |
| 5,819,658 | A | 10/1998 | Bornhorst, Jr. | |
| 5,820,478 | A * | 10/1998 | Wood | A63B 69/3652 473/279 |
| 5,831,641 | A * | 11/1998 | Carlson | B41J 3/4073 141/1 |
| 7,076,361 | B2 | 7/2006 | Wang et al. | |
| 7,658,146 | B2 | 2/2010 | Reinholdt | |
| 8,511,782 | B2 | 8/2013 | Chang et al. | |
| 2004/0179081 | A1 * | 9/2004 | Nimi | B41J 2/01 347/104 |
| 2008/0236417 | A1 | 10/2008 | Coffinardi et al. | |
| 2010/0039487 | A1 | 2/2010 | Sawatsky | |
| 2010/0264197 | A1 * | 10/2010 | Aoyama | B23K 1/08 228/219 |
| 2012/0274695 | A1 | 11/2012 | LaCaze et al. | |

FOREIGN PATENT DOCUMENTS

DE 4424528 A1 1/1996

* cited by examiner

*Primary Examiner* — Alejandro Valencia

(74) *Attorney, Agent, or Firm* — Klarquist Sparkman, LLP

(57) ABSTRACT

A printing system for an article of apparel includes an article receptacle device for receiving an article to be printed. The printing system includes a receptacle receiving system for receiving an article receptacle device with an article to be printed. The printing system can include an article positioning system for positioning an article receptacle device with an article to be printed. The printing system can include a linear actuating assembly for positioning an article receptacle device with an article to be printed. The printing system can include a printhead for printing an indicia portion on an article that corresponds to a design element on the article.

8 Claims, 39 Drawing Sheets

PRINTING SYSTEM FOR APPAREL

CROSS-REFERENCE TO RELATED APPLICATIONS

This application is a continuation-in-part of Ernest et al., U.S. patent application Ser. No. 14/723,756, filed May 28, 2015, published as U.S. Publication Number US-2016-0347086-A1, published on Dec. 1, 2016 and entitled "Printing System for Apparel," the disclosure of which is entirely incorporated herein by reference.

BACKGROUND

The present embodiments relate generally to printing systems and in particular to printing systems that can be used to print apparel as well as to print onto apparel.

Printing systems may utilize various components such as a printing device. The printing device can include a printhead, as well as ink cartridges to supply ink to the printhead.

BRIEF DESCRIPTION OF DRAWINGS

The embodiments can be better understood with reference to the following drawings and descriptions. The components in the figures are not necessarily to scale, emphasis instead being placed upon illustrating the principles of the embodiments. Moreover, in the figures, like reference numerals designate corresponding parts throughout the different views.

DETAILED DESCRIPTION OF DRAWINGS

Figure 1:
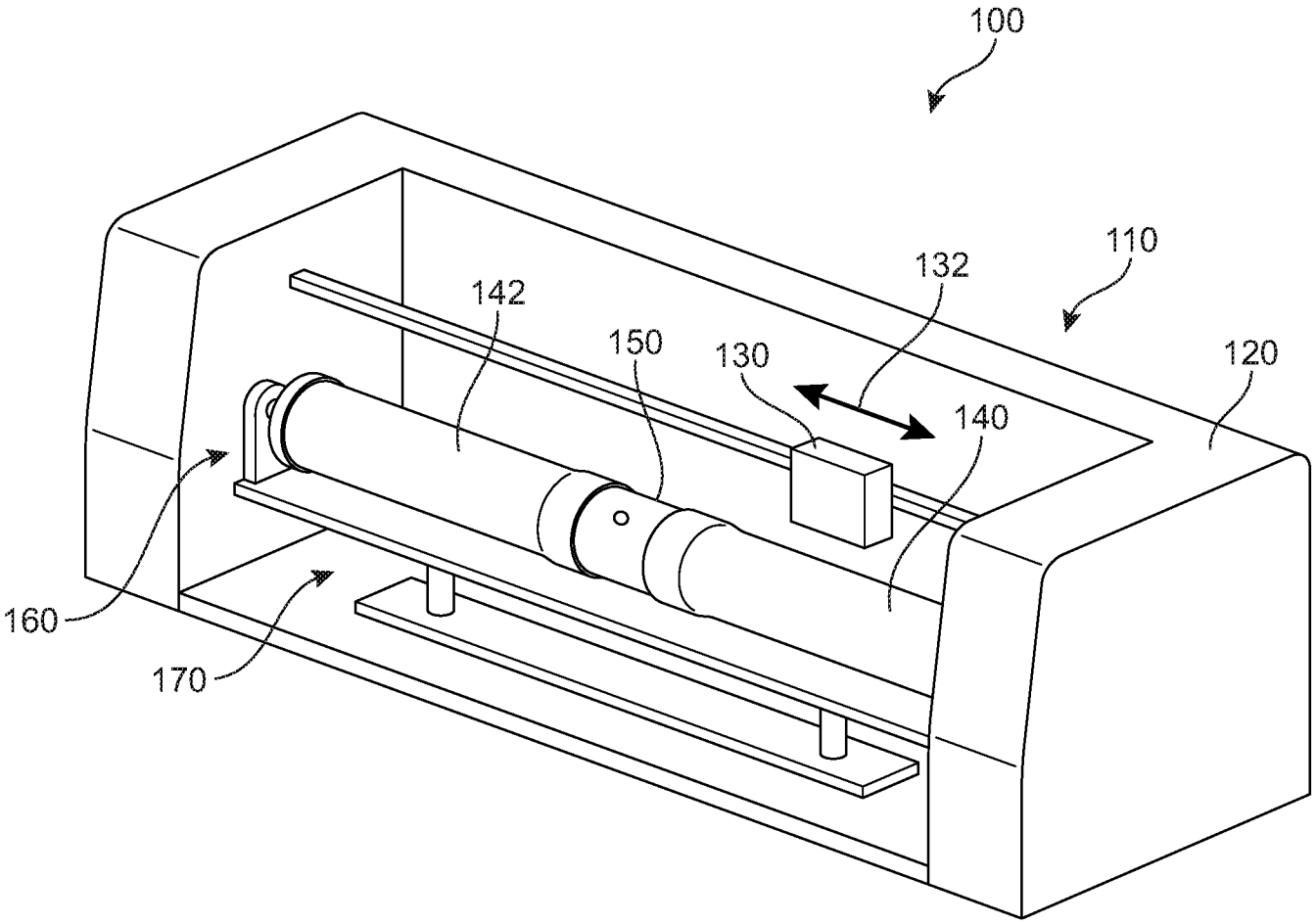
FIG. 1 is schematic view of an embodiment of a printing system.

In one aspect, the embodiments provide a printing system for printing onto an article of apparel and includes an article receptacle device configured to receive an article of apparel, and a printhead displaceable along a longitudinal axis. The article positioning member is configured to articulate the receptacle receiving frame along a vertical axis, perpendicular to the longitudinal axis, thereby allowing a distance between the article of apparel and the printhead to be varied.

The printhead is configured to apply ink to the article of apparel on the article receptacle device.

In another aspect, the embodiments provide a printing system for printing onto an article of apparel and includes an article receptacle device configured to receive an article of apparel, a receptacle receiving system configured to receive the article receptacle device, an article positioning system configured to move the receptacle receiving system, and a printhead displaceable along a longitudinal axis. The article receptacle device includes a receptacle end configured to receive a circumferential positioning member. The circumferential positioning member includes an alignment positioning portion. The receptacle receiving system includes a receptacle positioning member attached to a receptacle receiving frame, where the receptacle positioning member includes an alignment receiving portion. The alignment receiving portion is coupled with the alignment positioning portion for registration between the article receptacle device and the receptacle receiving system. The coupling between the alignment positioning portion and alignment receiving portion enables the article receptacle device to be rotated about a rotational direction.

In another aspect, the embodiments provide a printing system for printing comprising an article receptacle device configured to receive an article of apparel, and a printhead displaceable along a longitudinal axis. The article receptacle device has a first receptacle end and a second receptacle end. The article positioning system can move the article receptacle device between a horizontal configuration and a tilted configuration. The first receptacle end and the second receptacle end have a same vertical position along the vertical axis in the horizontal configuration, and a different vertical position along the vertical axis in the tilted configuration.

In another aspect, the embodiments provide a method of operating a printing system for printing onto an article of apparel. The method includes placing an article of apparel onto an article receptacle device. The method also includes positioning the article receptacle device onto the printing system, where the printing system receives information related to a thickness of the article of apparel. The method also includes dispersing an ink from the printhead onto a surface of the article of apparel. The method also includes determining if the printhead may contact a target portion of the article of apparel using the information related to the thickness of the article of apparel and tilting the article receptacle device to avoid contact between the printhead and the target portion of the article of apparel.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

FIG. 1 illustrates a schematic view of an embodiment of printing system 100. In some embodiments, printing system 100 may include print assembly system 110, including printing system housing portion 120. In some embodiments, printing system housing portion 120 may be used to house other components, devices, or systems of printing system 100. For example, printing system housing portion 120 may retain at least one printhead 130, receptacle receiving system 160, and article positioning system 170. For purposes of illustration, only some components of printing system 100 are shown in FIG. 1 and described below. It will be understood that in other embodiments printing system 100 may include additional provisions.

In some embodiments, printhead 130 disperses ink onto an article and is displaceable along longitudinal direction or longitudinal axis 132. In other embodiments, it is contemplated that printhead 130 could be translated in one or more directions that are perpendicular to longitudinal axis 132 as well. In some cases, longitudinal axis 132 may generally extend along a longest dimension of printing system 100. For purposes of illustration, a single printhead is shown in FIG. 1, however other embodiments could utilize one, two, three, or more than three different printheads.

Printing system 100 may utilize various types of printing techniques. These can include, but are not limited to, toner-based printing, liquid inkjet printing, solid ink printing, dye-sublimation printing, inkless printing (including thermal printing and UV printing), MEMS jet printing technologies as well as any other methods of printing. In some cases, printing system 100 may make use of a combination of two or more different printing techniques. The type of printing technique used may vary according to factors including, but not limited to, the material of the target article, size and/or geometry of the target article, desired properties of the printed image (such as durability, color, ink density, etc.) as well as printing speed, printing costs and maintenance requirements.

In some embodiments, printing system 100 may be associated with article of apparel 140, also referred to simply as article 140. In some embodiments however, printing system 100 need not be limited to use with articles of apparel, and the principles taught throughout this detailed description may be applied to additional articles as well. Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to, footwear, gloves, shirts, pants, socks, scarves, hats, jackets, as well as other articles. Other examples of articles include, but are not limited to, shin guards, kneepads, elbow pads, shoulder pads, as well as any other types of protective equipment. Additionally, in some embodiments, the article could be another type of article that is not configured to be worn, including, but not limited to; balls, bags, purses, backpacks, as well as other articles that may not be worn.

In some embodiments printing system 100, may include provisions to secure article 140 for printing. In some embodiments, provisions may include article receptacle device 150. In some other embodiments, article receptacle device 150 may load more than one article. As shown in FIG. 1, article receptacle device 150 may also load second article 142.

Printing system 100 may include features to secure other components in place relative to printing system housing portion 120. In some embodiments, receptacle receiving system 160 may be used to receive article receptacle device 150 onto printing system housing portion 120. In some other embodiments, article positioning system 170 may be used to position article receptacle device 150 variable distances from printhead 130.

Figure 2:
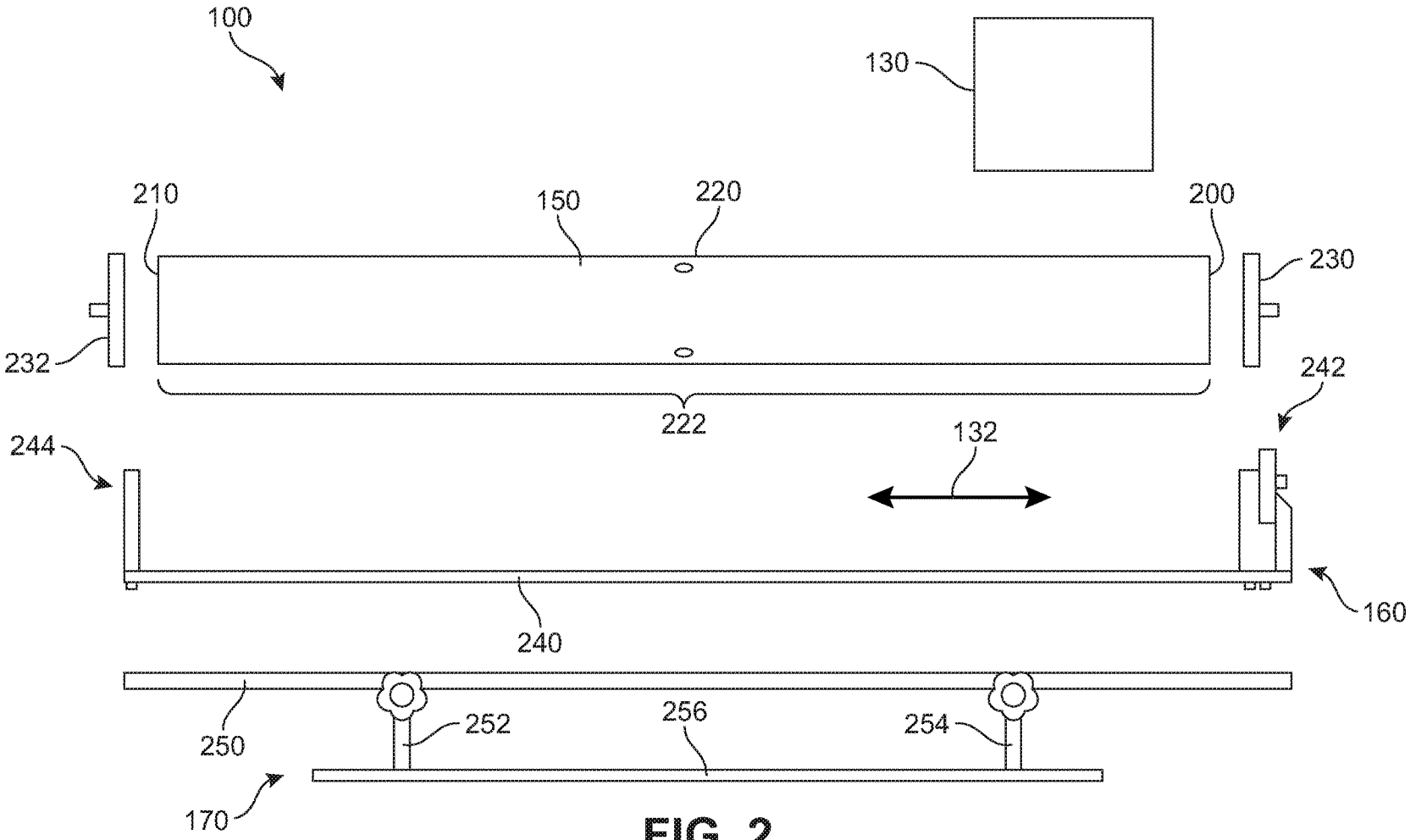
FIG. 2 is an exploded front view of an embodiment of a printing system.

FIG. 2 depicts an exploded view of some components of printing system 100. In some embodiments, printing system 100 may include provisions for receiving a plurality of articles or a singular article to be printed. As previously stated, in some embodiments, article receptacle device 150 can be used for loading articles onto printing system 100.

In some embodiments, article receptacle device 150, may include first receptacle end 200, second receptacle end 210, and receptacle midpoint 220. In some cases, article receptacle device 150 may be dimensioned along a set of axes. For example, article receptacle device 150 may have longitudinal length 222, running lengthwise along longitudinal axis 132 and disposed between first receptacle end 200 and second receptacle end 210. In some embodiments, receptacle midpoint 220 may demarcate the middle of the article receptacle device 150 wherein first receptacle end 200 and second receptacle end 210 are equidistant. In some embodiments, article receptacle device 150 may have more receptacle ends. In some other embodiments, article receptacle device 150 may have fewer receptacle ends.

In some cases, printing system 100 may include provisions to secure an article onto article receptacle device 150 for printing. As shown in FIG. 2, in some embodiments, a first article (not shown) may be secured to article receptacle device 150 at first receptacle end 200 with first circumferential positioning member 230. In some other embodiments, a second article (not shown) may be secured to article receptacle device 150 at second receptacle end 210 with second circumferential positioning member 232. In some embodiments, only first circumferential positioning member 230 may be used. In those embodiments utilizing only first circumferential positioning member 230, a simple end cap (not shown) may be used at second receptacle end 210 to secure an article to article receptacle device 150.

In some embodiments, printing system 100 may include provisions to receive article receptacle device 150 having an article to be printed. In some embodiments, provisions may include receptacle receiving system 160 to receive the article receptacle device 150 to printing system 100 to facilitate printing. In some cases, receptacle receiving system 160 may include receptacle receiving frame 240.

In some cases, article receptacle device 150 may be placed onto receptacle receiving frame 240 for printing. In different embodiments, the geometry of receptacle receiving frame 240 can vary. In some cases, receptacle receiving frame 240 may have a substantially linear geometry. In some other embodiments, receptacle receiving frame 240 may have a non-linear geometry.

In some embodiments, receptacle receiving system 160 may include features to secure article receptacle device 150 onto receptacle receiving frame 240. In some embodiments, receptacle positioning member 242 may be used to secure at least one end of article receptacle device 150 with first circumferential positioning member 230 onto receptacle receiving frame 240. In some other embodiments, receptacle receiving member 244 may be used to secure a second end of article receptacle device 150 onto receptacle receiving frame 240.

In some embodiments, printing system 100 may include provisions to move article receptacle device 150 with an article closer to or farther away from printhead 130 during operation. In some embodiments, provisions may include article positioning system 170.

In some cases, article positioning system 170 may have article positioning device 250. In some embodiments, article positioning device 250 may be used to facilitate the movement of receptacle receiving frame 240. In some embodiments, receptacle receiving frame 240 may overlay article positioning device 250.

In some embodiments, article positioning system 170 may include first article positioning member 252. First article positioning member 252 may be used to enable movement of article positioning device 250 in a linear direction perpendicular to longitudinal axis 132. In some embodiments, second article positioning member 254 may be included to enable movement of article positioning device 250 in a linear direction independent from first article positioning member 252. In some cases, first article positioning member 252 and second article positioning member 254 may be attached to article positioning device 250. In some other embodiments, article positioning device 250 may be absent, and first article positioning member 252 and second article positioning member 254 may be directly attached to receptacle receiving frame 240.

In some embodiments, article positioning system 170 may also include article positioning base 256. Article positioning base 256 may be placed underneath first article positioning member 252 and/or second article positioning member 254 for increased stability during printing operation.

Figure 3:
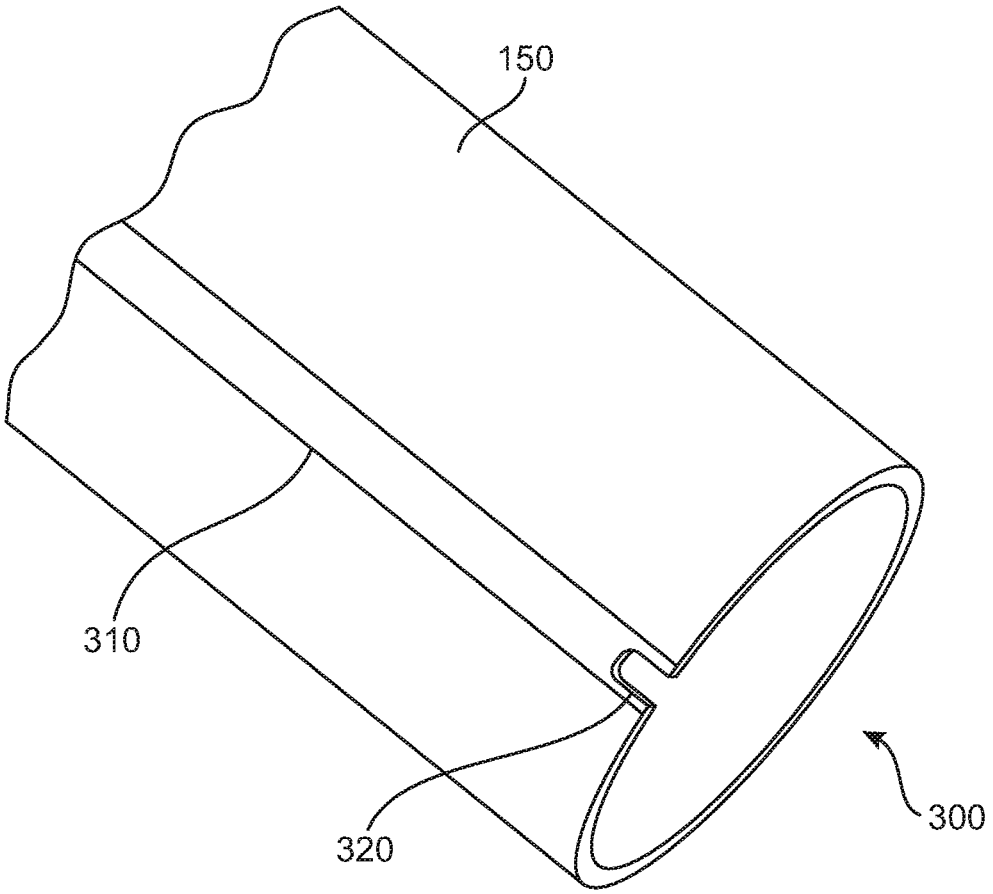
FIG. 3 is a partial schematic view of an embodiment of an article receptacle device.

As stated previously, in some cases, an article can be held with the use of article receptacle device 150. FIG. 3 depicts a partial schematic view of article receptacle device 150 that may hold an article to be printed.

In some embodiments, article receptacle device 150 may be substantially cylindrical in shape. In those embodiments having article receptacle device 150 with a substantially cylindrical shape, the cross section of article receptacle device 150 may be substantially circular. However, other embodiments may utilize article receptacle device 150 having other kinds of cross-sectional shapes including rectangular, triangular, regular, irregular, as well as any other kinds of cross-sectional shapes. Moreover, in the exemplary embodiment of FIG. 3, article receptacle device 150 may be substantially hollow. However, in other embodiments, article receptacle device 150 may not be hollow.

In some embodiments, article receptacle device 150, having a substantially cylindrical geometry, may receive an article with a substantially tubular geometry, such as a sock (not shown). In some embodiments, when a sock (not shown) is placed at first receptacle end 300 and mounted onto article receptacle device 150, the sock may conform to the cylindrical shape of article receptacle device 150.

Some devices for holding an article for printing may include provisions for centering or aligning an article loaded on the device. In some embodiments, these provisions facilitate printing at correct locations of an article. In an exemplary embodiment, article receptacle device 150 may include alignment guide 310 axially aligned for centering or positioning an article in a known position. For example, alignment guide 310 may be used to reference a front side of an article, such as a sock, when mounted on article receptacle device 150. Printing system 100 will then have a point or points of reference for printing on the article. In some cases, article receptacle device 150 may include multiple alignment guides. In some other cases, alignment guide 310 may be absent.

In some embodiments, printing system 100 may include provisions to ensure an article is in a known position when mounted on article receptacle device 150. In some embodiments, article receptacle device 150 may include notch member 320 for facilitating accurate printing on an article. In some cases, article receptacle device 150 may include multiple notch members. In some other cases, notch member 320 may be absent. The utility of notch member 320 in facilitating desired alignment between components is discussed below.

In some embodiments, printing system 100 may include other provisions for the precise alignment and placement of printed portions on an article, also known as registration. In some embodiments, it may be useful to provide a user with a way of aligning an article with printing system 100 to ensure printed information is printed in the desired portions of the article.

Figure 4:
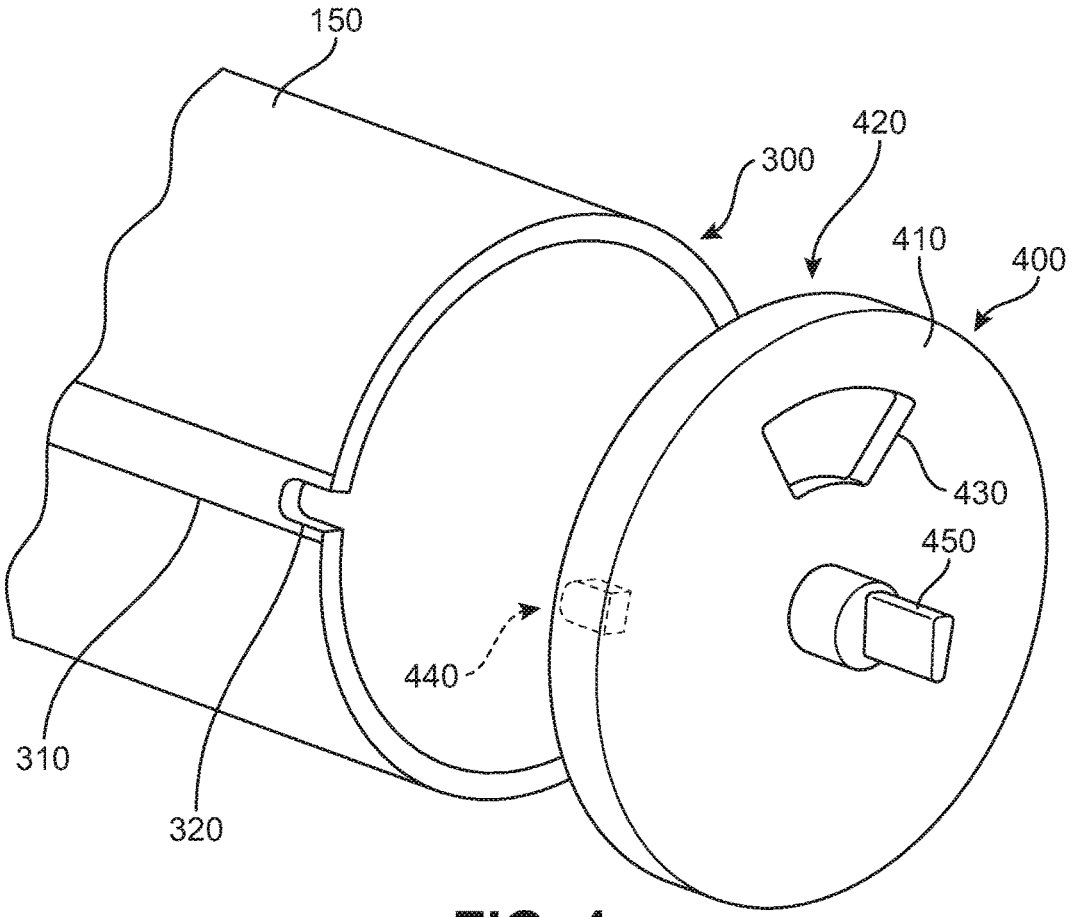
FIG. 4 is a partial schematic view of an embodiment of a circumferential positioning member configured with an article receptacle device.

As shown in FIG. 4, registration provisions may include circumferential positioning member 400 configured with article receptacle device 150 for accurate registration. In some embodiments, circumferential positioning member 400 may include first surface 410 and second surface 420 opposite first surface 410. In some cases, circumferential positioning member 400 may be substantially solid or include openings 430. In some embodiments, circumferential positioning member 400 may be placed over first receptacle end 300 to secure an article onto article receptacle device 150.

In some cases, circumferential positioning member 400 may include mating tab portion 440, depicted in phantom lines for purposes of illustration. In some embodiments, mating tab portion 440 may be configured for notch member 320 of article receptacle device 150. Therefore, when mating tab portion 440 is secured to notch member 320, a known and fixed angular alignment between circumferential positioning member 400 and article receptacle device 150 may be achieved.

Some embodiments may include provisions for facilitating the rotation of article receptacle device 150 during printing operations. In some embodiments, provisions include alignment positioning portion 450 that may enable the rotation of article receptacle device 150. In some cases, alignment positioning portion 450 may be a shaft-like structure. More specifically, in some embodiments, alignment positioning portion 450 may be somewhat flattened with an approximately wedge-like cross-sectional shape. In some cases, this approximately wedge-like cross-sectional geometry may define a particular orientation at which alignment positioning portion 450 may engage with a corresponding structure, bringing them into axial alignment with each other. In some other embodiments, alignment positioning portion 450 may have a different geometric structure.

In some embodiments, printing system 100 may include provisions to facilitate printing onto articles disposed on article receptacle device 150, including articles such as socks, having curved and/or non-planar geometries. In some embodiments, printing system 100 may include provisions to rotate article receptacle device 150 so that ink may be dispersed over any portion of an underlying article, including portions having any angular or circumferential positions with respect to a central axis of article receptacle device 150. In some embodiments, receptacle receiving system 160 can be used to facilitate the rotation of article receptacle device.

Figure 5:
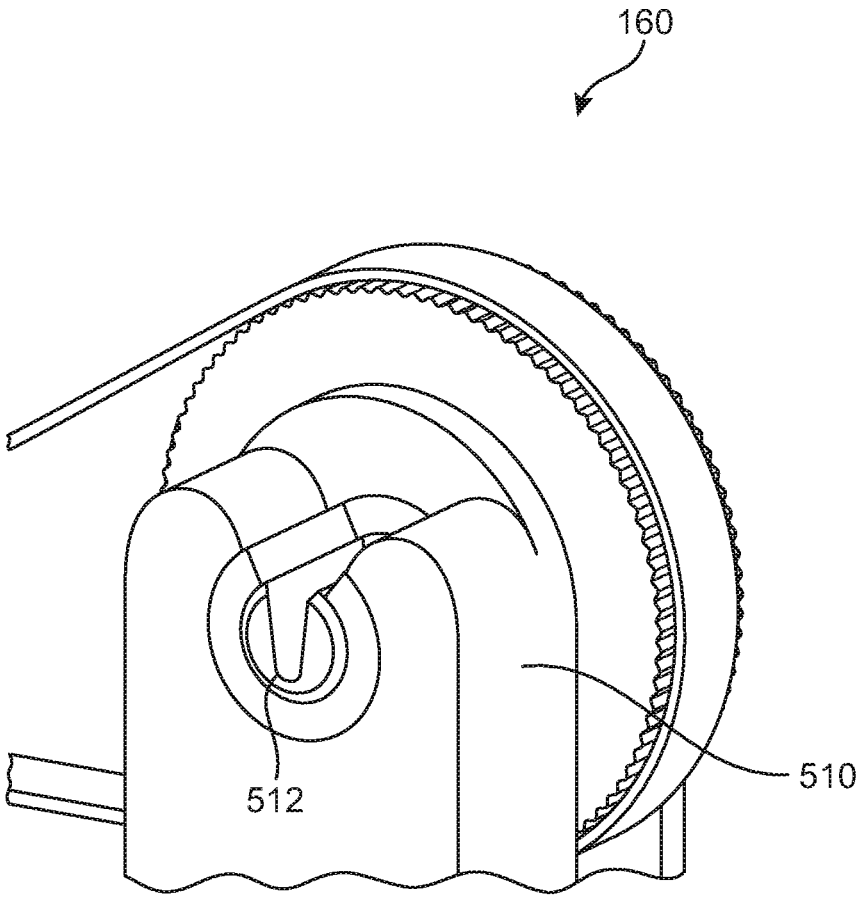
FIG. 5 is a partial schematic view an embodiment of a receptacle receiving system with receptacle positioning member.

FIG. 5 illustrates an exemplary receptacle receiving system 160 to facilitate printing of an article with a curved geometric surface. In some embodiments, receptacle receiving system 160 may include devices to receive and rotate article receptacle device 150. In some embodiments, receptacle receiving system 160 may include devices having an aperture or a slot structure. The slot structure may be used to obtain a fixed and known alignment between receptacle receiving system 160 and article receptacle device 150 when connected. In some cases, such devices may include receptacle positioning member 510. In an exemplary embodiment, receptacle positioning member 510 may include alignment receiving portion 512 dimensioned to receive and connect with alignment positioning portion 450 on circumferential positioning member 400 (as shown, for example, in FIG. 4).

In embodiments where alignment positioning portion 450 has an approximately wedge-like geometry, alignment receiving portion 512 could include a corresponding wedge-like opening or slot to receive alignment positioning portion 450. In at least some embodiments, the approximately wedge-like geometry of alignment positioning portion 450 and corresponding geometry of alignment receiving portion 512 ensures that article receptacle device 150 can only be attached to receptacle receiving system 160 at a singular position. Of course, in other embodiments, other geometries for alignment positioning portion 450 and alignment receiving portion 512 could be utilized to achieve a similar unique and angular position for attaching article receptacle device 150 to receptacle receiving system 160 in order to facilitate alignment of the printing system with an article. Moreover, still other embodiments could utilize geometries that allow article receptacle device 150 to be attached at more than one unique angular position.

Figure 6:
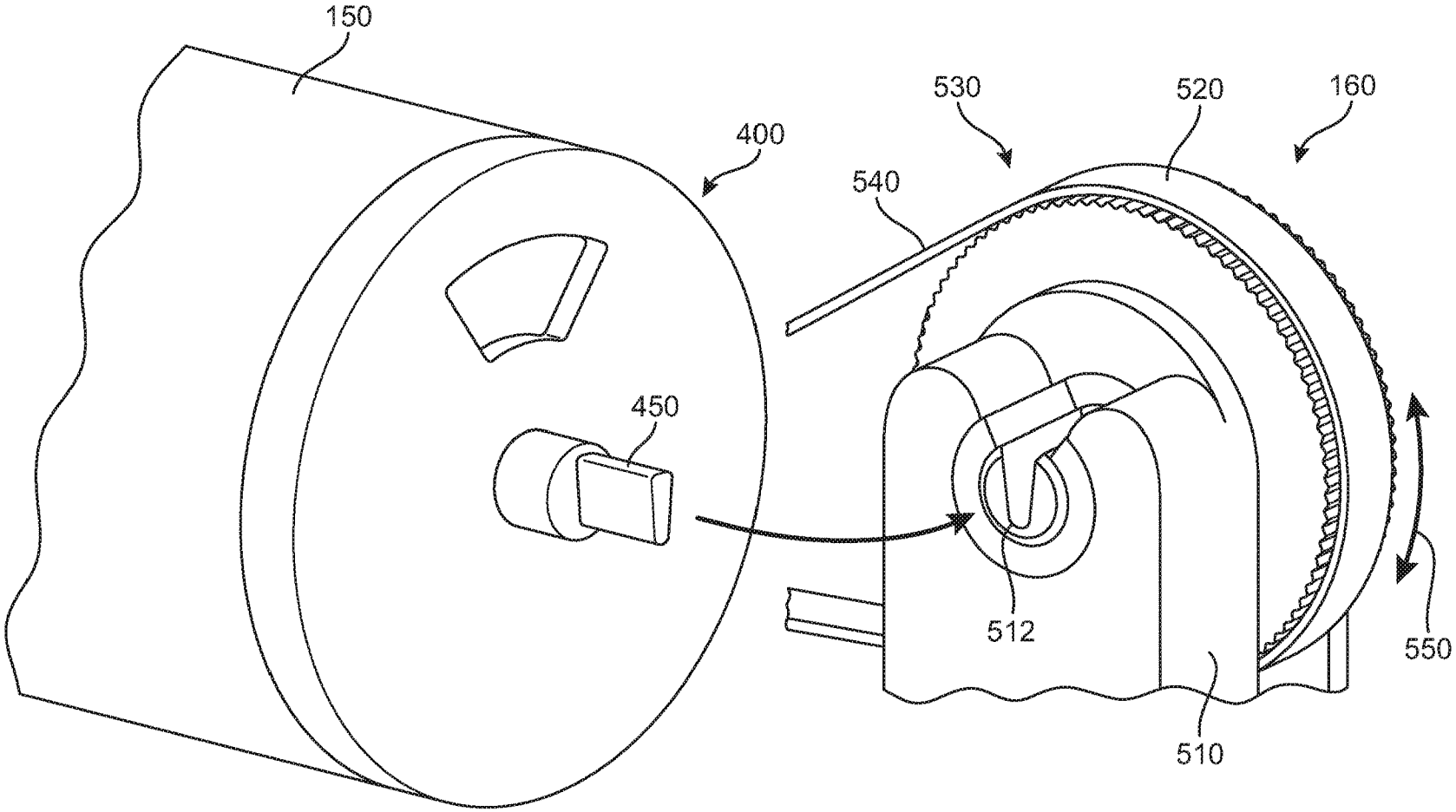
FIG. 6 is a partial schematic view of an embodiment of a receptacle receiving system configured to receive the article receptacle device and circumferential positioning member.

As illustrated in FIG. 6, in some embodiments, the connection of the receptacle positioning member 510 with circumferential positioning member 400 creates a coupling and supports the rotation of article receptacle device 150 about rotational direction 550. More specifically, rotational direction 550 corresponds to the rotational direction along a central axis of article receptacle device 150 through which article receptacle device 150, and any article disposed on article receptacle device 150, may rotate. In some cases, rotational direction 550 may be defined about a central longitudinal axis of article receptacle device 150. However, in other cases, rotational direction 550 could be defined about the central axis of another component, such as receptacle positioning member 510.

In some embodiments, the connection between circumferential positioning member 400 and receptacle positioning member 510 also supports the registration between article receptacle device 150 and components of receptacle receiving system 160, for continuous printing of an article having a non-planar surface. In some other embodiments, the connection further defines an angular orientation about alignment receiving portion 512 for use as a reference point during the printing process.

As depicted in FIG. 6 receptacle positioning member 510 including alignment receiving portion 512 with a slotted structure, may receive circumferential positioning member 400 comprising alignment positioning portion 450 with a shaft-like structure. In an exemplary embodiment, when alignment positioning portion 450 is coupled with alignment receiving portion 512, the connection results in an initial or first angular position having a zero-degree angle. Thus, when a torque is applied, alignment receiving portion 512 may then rotate about rotational direction 550, and adjust the angular position of alignment receiving portion 512 and alignment positioning portion 450 (with article receptacle device 150) from its first angular position of 0 degrees to a second angular position. Therefore, in some embodiments, an angular alignment between the alignment receiving portion 512 and alignment positioning portion 450 is known providing a reference for printhead registration during operation.

In some embodiments, the rotation of article receptacle device 150 and circumferential positioning member 400 connected to receptacle positioning member 510 may be controlled automatically using any motorized system known in the art. In an exemplary embodiment, drive pulley 520 may be coupled to motor system 530 and engaged with a driven pulley (not shown) by drive belt 540 to support the rotation of article receptacle device 150 during printing operations.

In some embodiments, printing system 100 may include provisions for determining a known position along the circumference of a circumferential positioning member 400, and correspondingly the rotational position of the receptacle positioning member 510. In some cases, by using this predetermined circumferential position of circumferential positioning member 400 and the rotational position of receptacle positioning member 510, accurate registration between an article mounted onto article receptacle device 150 and components of printing system 100 can be achieved.

In some embodiments, a position sensor system (not shown) can be used to determine a circumferential position on circumferential positioning member 400, and the rotational position of receptacle positioning member 510. Such a positioning sensor system allows for proper placement of printed information on an article. In some embodiments, a position sensor system similar to crank angle sensor systems used in internal combustion engines could be used. Examples of engine crank angle sensor systems are disclosed in U.S. Pat. No. 4,235,101 to Stadelmann; U.S. Pat. No. 5,548,995 to Allen et al.; and U.S. Pat. No. 7,076,361 to Wang et al., each of which is hereby incorporated by reference in their entirety.

Embodiments can include provisions for printing to articles with geometries that are non-planar, curved, or otherwise irregular along a direction corresponding to the longitudinal axis of article receptacle device 150. For example, embodiments can include provisions for maintaining an approximately constant distance between printhead 130 and portions of an article beneath printhead 130 even when the article's thickness and/or geometry varies.

In an exemplary embodiment, by adjusting the distance between an article and printhead 130, issues that may occur when trying to print on a three-dimensional article are minimized.

Some embodiments of printing system 100 may include provisions for moving an article mounted onto article receptacle device 150 proximate to or farther away from print assembly system 110 with respect to a vertical axis perpendicular to longitudinal axis 132. In some embodiments, these provisions may include devices for vertically lifting and/or tilting article receptacle device 150 in order to adjust distances from printhead 130. In some printing systems 100, by adjusting the distance between printhead 130 and an article with varying thickness, printhead 130 travelling along a longitudinal axis 132 may avoid contacting the surface of article.

In some embodiments, article positioning system 170 may include mechanisms to facilitate the movement of receptacle receiving system 160 with article receptacle device 150. Some exemplary devices known in the art may include linear actuators enabling motion in a straight line, such as pistons, or rack and pinion devices. In some other exemplary embodiments, the devices may be a rotary actuator enabling movement in a circular motion.

Figure 7:
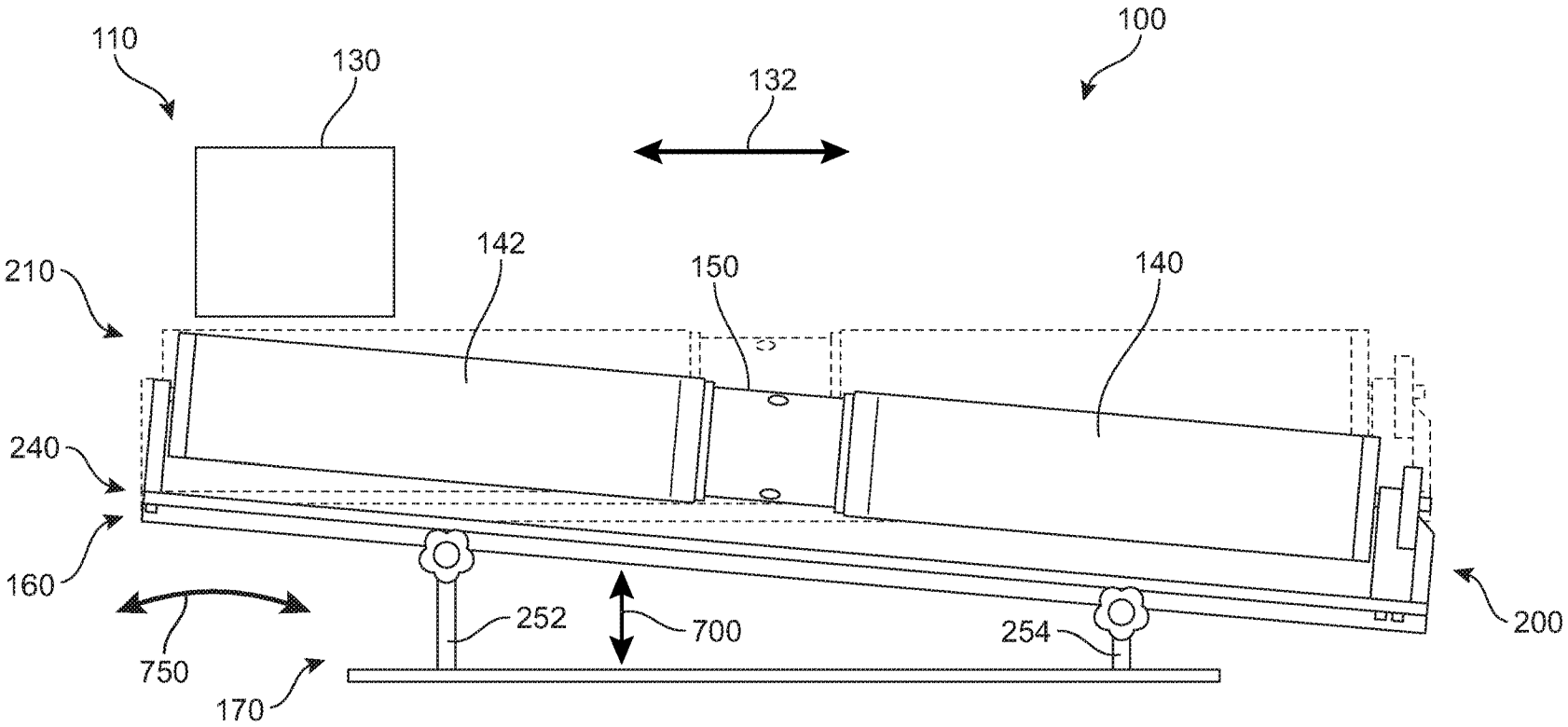
FIG. 7 is a front schematic view of an embodiment of a printing system during operation.

As illustrated in FIG. 7, an exemplary embodiment of printing system 100 may include article positioning system 170. In some embodiments, article positioning system 170 may adjust a distance between printhead 130 and a plurality of articles including, but not limited to, article 140 and/or second article 142, mounted onto article receptacle device 150. In some cases, this is accomplished by moving components of receptacle receiving system 160 including receptacle receiving frame 240. In some embodiments, article positioning system 170 may include at least first article positioning member 252. As previously mentioned, in some cases, first article positioning member 252 may be a linear actuator. In some embodiments, first article positioning member 252 can move components of receptacle receiving system 160 having article receptacle device 150 with article 140, and/or second article 142, in an up or down position along vertical axis 700 that is perpendicular to longitudinal axis 132, and relative to printhead 130.

In some embodiments, article positioning system 170 may include second article positioning member 254. In some cases, first article positioning member 252 and second article positioning member 254 may move article receptacle device 150 together simultaneously along vertical axis 700 such that article receptacle device is substantially horizontal during movement. In some other cases, first article positioning member 252 may move along vertical axis 700 independently from second article positioning member 254 such that article receptacle device 150 may tilt at an angle relative to longitudinal axis 132. In other words, article receptacle device 150 may be tilted along tilting direction 750 as first article positioning member 252 moves independently from second article positioning member 254. As used herein, the term "tilting direction" or "tilting motion" refers to a possible movement or motion of article receptacle device 150 (i.e., a degree of freedom or mode of movement) where first receptacle end 200 has a different vertical position (e.g., height or displacement) from second receptacle end 210. In some embodiments, second article positioning member 254 may be absent.

FIG. 7 depicts the ability of article positioning system 170 to actuate some of its components independently. Phantom lines depict a starting position, where article receptacle device 150 and article positioning system 170 are substantially horizontal. Article positioning system 170, and its components, first article positioning member 252 and second article positioning member 254, may subsequently reposition portions of receptacle receiving system 160 including receptacle receiving frame 240 and article receptacle device 150, such that second receptacle end 210 may be higher than first receptacle end 200 or vice versa.

By allowing the independent movement of first article positioning member 252 from second article positioning member 254, article receptacle device 150 may be tilted at an angle relative to longitudinal axis 132. In some embodiments, a single article positioning member can be configured to adjust both the vertical position along vertical axis 700 and a tilting position along tilting direction 750 of article receptacle device 150, in other words a single article positioning member can be a linear actuator and a rotational actuator.

Figure 8:
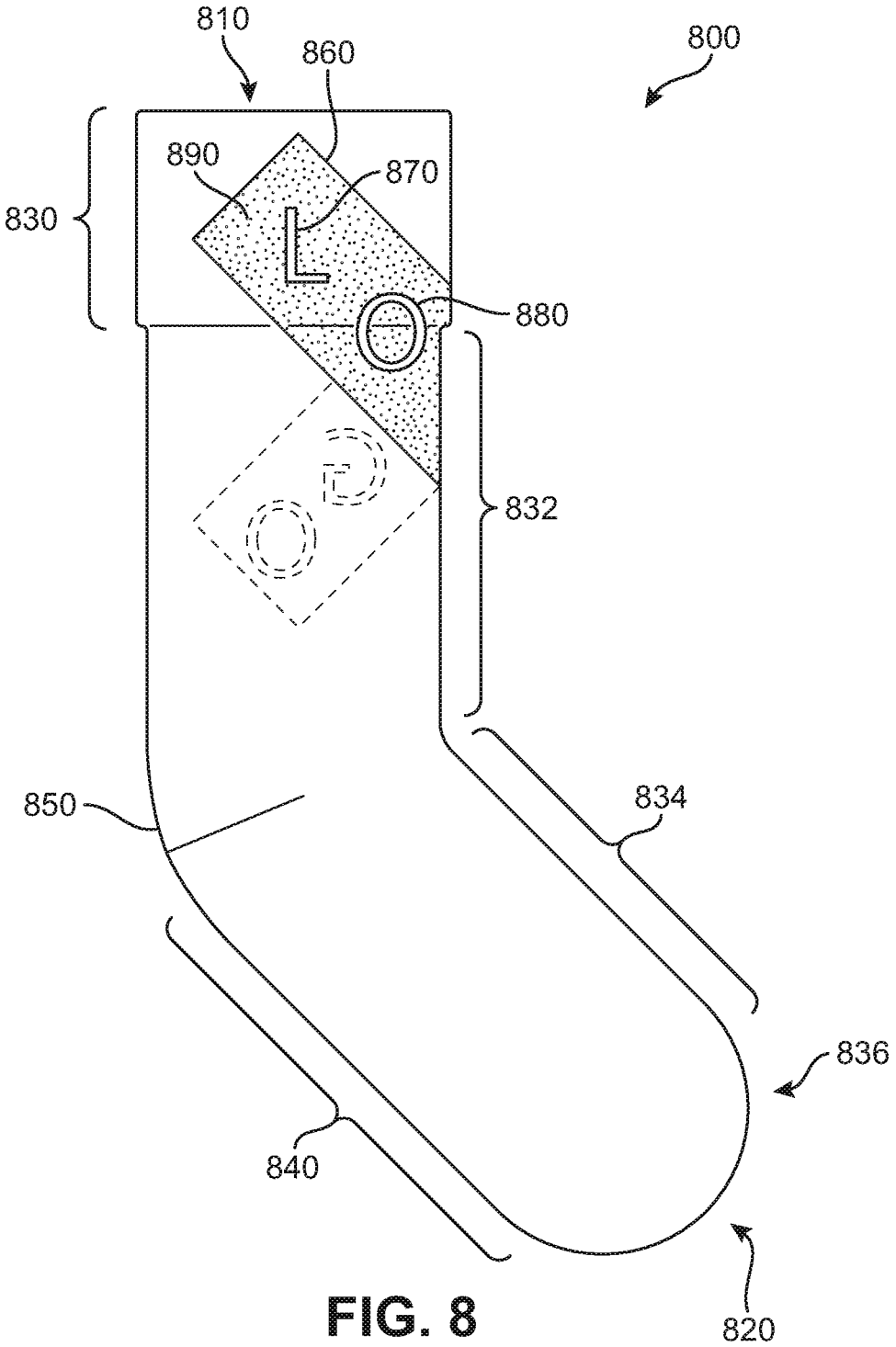
FIG. 8 is a schematic view of an embodiment of an article of apparel.

As shown in FIG. 8, in some embodiments, article 800 can take the form of a sock. However, the articles of the embodiments may generally include any articles that can be placed onto article receptacle device 150 for printing, as described below.

In some embodiments, article 800 can include first article end 810 and second article end 820. In some cases, first article end 810 may be associated in the vicinity of the calf of a leg when article 800 is worn. Also, in some cases, second article end 820 may be associated in the vicinity of the toes of a foot.

In some embodiments, article 800 may include portions associated with other regions of the leg and foot when worn. In some other cases, article 800 may have portions that are also associated with thicker regions or regions with less thickness. In some other embodiments, article 800 can include cuff portion 830, leg portion 832, instep portion 834, toe portion 836, sole portion 840, and heel portion 850.

In some embodiments, article 800 can include indicia portion 860. Indicia portion 860, as used in this detailed description and in the claims, can refer to both singular and a plurality of markings created from the dispersion of ink from printhead 130 onto the article 800. In some cases, indicia portion 860 can include logo 870, having lettering portion 880 and background portion 890. In some other embodiments, indicia portion 860 may include a variety of other forms including, but not limited to, shapes, alphanumeric characters and/or other types of markings.

In some embodiments, indicia portion 860 can be associated with various portions of article 800. In an exemplary embodiment, indicia portion 860 can be associated with cuff portion 830 comprising thicker material, and also leg portion 832 having less material than cuff portion 830 as shown in FIG. 8.

In some embodiments, indicia portion 860 can extend around a portion of the circumference on the surface of article 800. In some other cases, indicia portion 860 can extend along a portion of the length of article 800.

FIGS. 9-15, illustrate an embodiment of a generic process for printing on an article by printing system 100. For clarity, the following detailed description discusses an exemplary embodiment, in which printing system 100 is used to print indicia portions to an article, for example a sock.

In some embodiments, some of the following steps may be controlled by a control unit associated with printing system 100. In some other embodiments, these steps may be performed by additional systems or devices associated with printing system 100. For example, for printing systems with sensors or devices for measuring various parameters, one or more steps could be performed by sensors or devices. In addition, in embodiments where printing system 100 is in communication with a computer (not shown), one or more steps could be performed by the computer. In addition, it will be understood that in other embodiments, one or more of the following steps may be optional.

Figure 9:
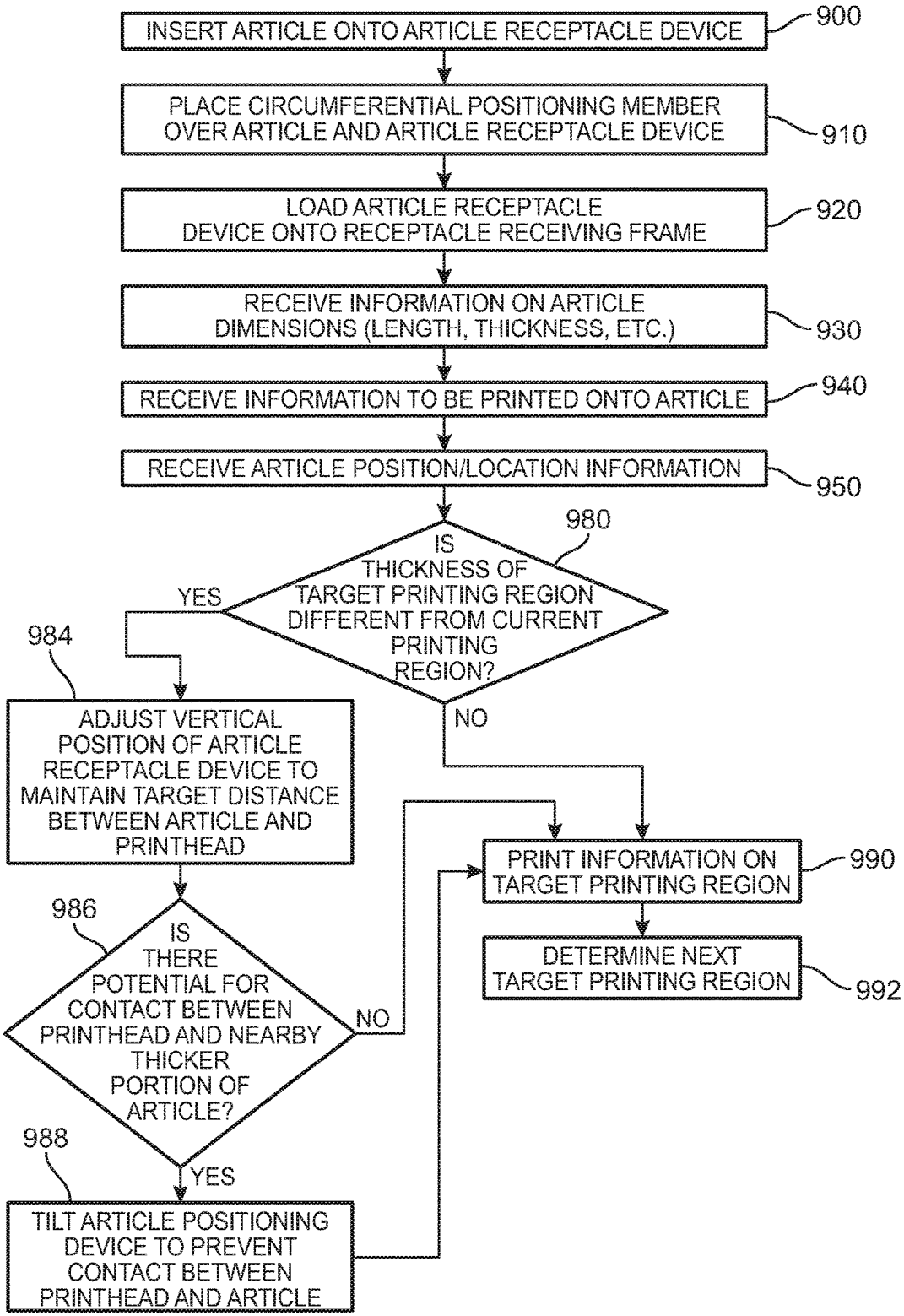
FIG. 9 is an embodiment of a process for printing on an article with varying thickness.
Figure 10:
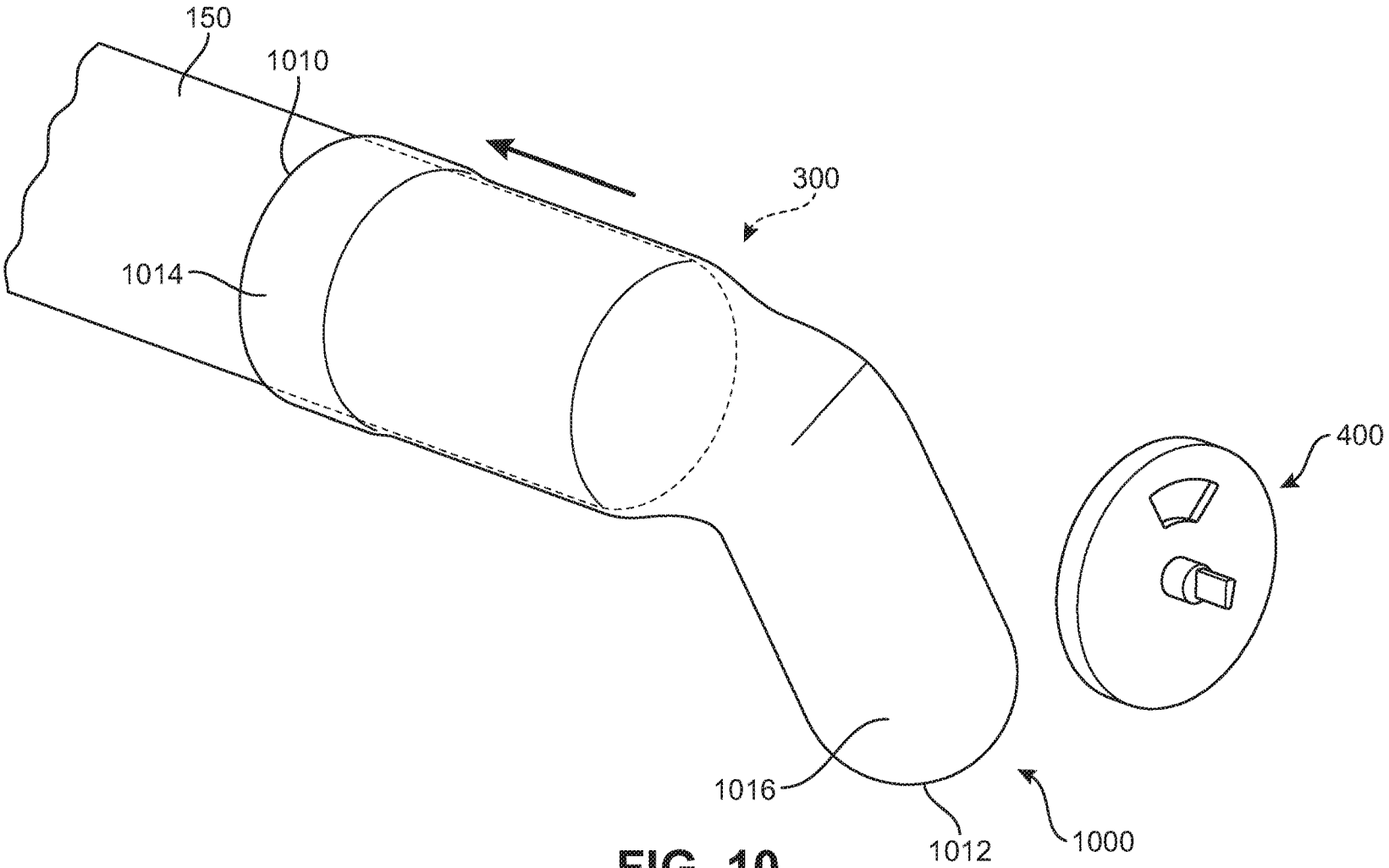
FIG. 10 is a schematic view of an article of apparel being placed onto an article receptacle device.

During step 900 in FIG. 9, an article may be inserted onto article receptacle device 150 having a substantially cylindrical shape. As shown in FIG. 10, article 1000 could be in the form of a sock for example, similar to the sock described in FIG. 8. In some embodiments, article 1000 is first placed over article receptacle device 150 by inserting first article end 1010 in the vicinity of cuff portion 1014 over first receptacle end 300. Article 1000 may be pulled toward midpoint (not shown) of article receptacle device 150 until second article end 1012 in the vicinity of toe portion 1016 is taut against first receptacle end 300. In some embodiments, once article 1000 is loaded onto article receptacle device 150, circumferential positioning member 400 may be used to secure article 1000 in place.

Figure 11:
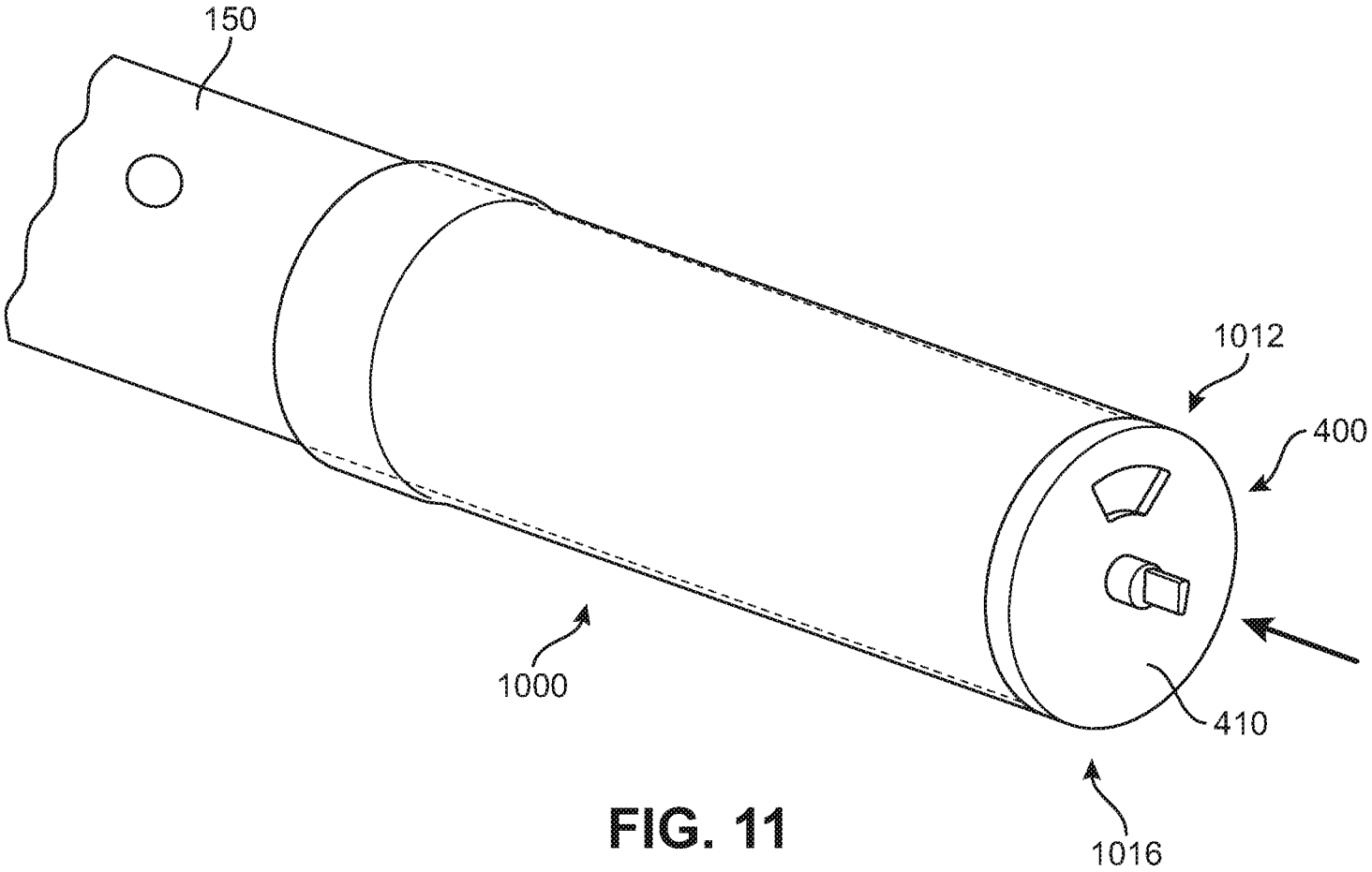
FIG. 11 is a schematic view of an embodiment of a circumferential positioning member being placed over an article of apparel loaded onto an article receptacle device.

Once the article is mounted and secured onto article receptacle device 150, an exemplary next step 910 in FIG. 9, and as illustrated in FIG. 11, includes securing article 1000. In some embodiments, article 1000 may be secured by placing circumferential positioning member 400 over second article end 1012, such that second surface 420 (See FIG. 4), opposite first surface 410, covers toe portion 1016 of article 1000.

As stated earlier, article receptacle device 150 and circumferential positioning member 400 may include devices to facilitate registration and properly align article 1000 for printing. In some cases, the use of an alignment guide and a notch member on article receptacle device 150, with a mating tab on circumferential positioning member 400, facilitates accurate registration and proper alignment with components of printing system 100 during use.

Figure 12:
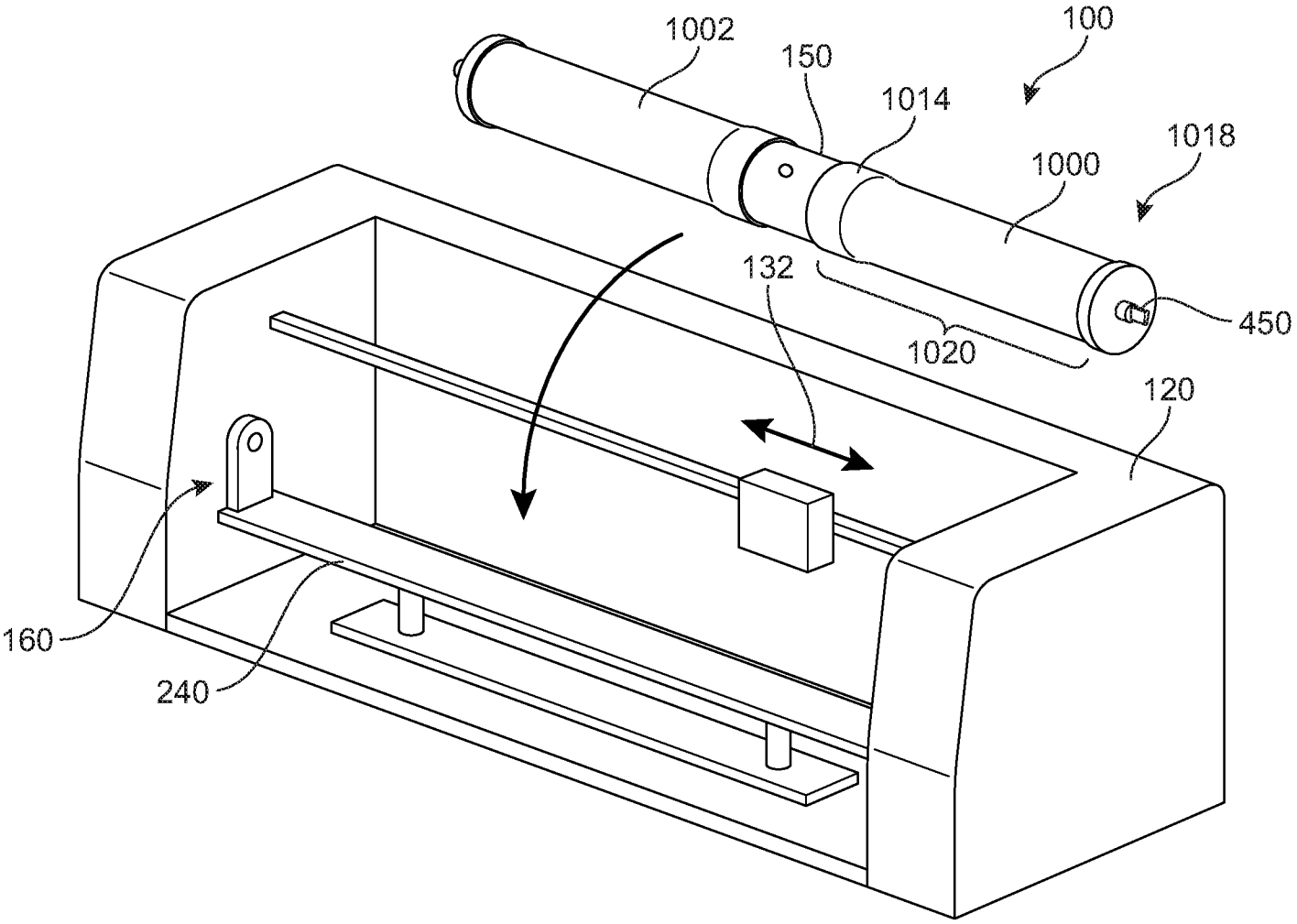
FIG. 12 is a schematic view of an embodiment of a printing system where an article receptacle device is placed onto the printing system.

FIG. 12 illustrates a schematic view of printing system 100 for exemplary step 920 in FIG. 9. In some embodiments, article 1000 may be mounted onto article receptacle device 150 and loaded onto printing system housing portion 120 for printing. In some embodiments, second article 1002 may also be mounted onto article receptacle device 150 for printing. In some embodiments, article receptacle device 150 may be placed onto receptacle receiving frame 240 of receptacle receiving system 160. As illustrated previously in FIG. 6, in some cases, a connection is made by inserting alignment positioning portion 450 of circumferential positioning member 400 onto components of receptacle receiving system 160.

In some embodiments, once article receptacle device 150 is secured onto receptacle receiving system 160, a control unit of printing system 100 may receive information concerning article 1000 as indicated in FIG. 9 step 930. In some embodiments, the information may include article dimension information. For example, the article dimension information may include longitudinal length 1020 of article 1000 or concerning the circumferential region of the article.

In some cases, article dimension information can include a thickness if some portions are thicker than other portions, such as cuff portion 1014 or leg portion 1018. In some embodiments, by receiving this information, printing system 100 will know when to adjust the distance between printhead 130 and the surface of article 1000 in order to avoid printhead 130 from contacting the surface of article 1000. Distances between printhead 130 and article 1000 may also need to be adjusted to properly disperse ink, thus ensuring indicia portion is properly applied.

In some embodiments, after receiving article dimension information, step 940 and step 950 in FIG. 9 indicate that a control unit may receive information related to an indicia portion including but not limited to, locations of markings, types of lettering, and different colors to be applied on article 1000.

In step 980, a control unit may determine the thickness of a target portion or printing region based on information about the article received in step 930, as well as location information received during step 950. Here, the target printing region may be at a longitudinal position ahead of the printhead, i.e., a portion of the article where the printhead will soon pass over for printing. If, during step 980, the control unit determines that the thickness of the upcoming printing region is not different than the thickness of the current printing region, the control unit may proceed to step 990 where the printhead prints to the target printing region. The control unit may then determine the next target printing region in step 992, so that the process may be repeated.

If, during step 980, the control unit determines that the thickness of the article at a target printing region is different from the thickness of the article at the current printing region (i.e., the region or portion directly under the printhead), the control unit may proceed to step 984. In step 984, the control unit may adjust the vertical position of the article receptacle device to maintain a desired target distance between the article and the printhead. For example, if the target printing region is thicker than the current printing region (e.g., the target printing region is on a thicker cuff of a sock and the current printing region is on a thinner leg portion of the sock), the control unit may raise the article receptacle device by an amount that maintains the desired target distance. If the target printing region is thinner than the current printing region, the control unit may lower the article receptacle device to maintain the desired target distance.

In addition to raising and lowering the article receptacle device in the vertical direction, the control unit may be capable of tilting the article receptacle device (either using a rotational actuator or by raising or lowering each end of the article receptacle device by a different amount). Titling the article receptacle device may allow the printhead to maintain a desired target distance over a portion of an article while avoiding contact with an adjacent portion that might interfere (i.e., contact) the printhead if the article receptacle device is raised or lowered uniformly (e.g., a constant amount along its entire length).

At step 986, a control unit may determine if there is a potential for contact between a printhead and a nearby thicker portion of an article. If so, the control unit may tilt the article receptacle device during step 988, to help maintain the desired target distance with any underlying region of the article while avoiding contact between the printhead and the thicker portion of the article. Following step 988, the control unit may proceed to step 990 to continue printing. If, during step 986, there is no potential for contact or interference between the printhead and the article, the control unit may also proceed to step 990.

FIGS. 13 through 19 illustrate exemplary situations where an article has non-planar portions and/or portions of varying thickness, and where it may be necessary to tilt and/or adjust the vertical position of an article receptacle device.

Figure 13:
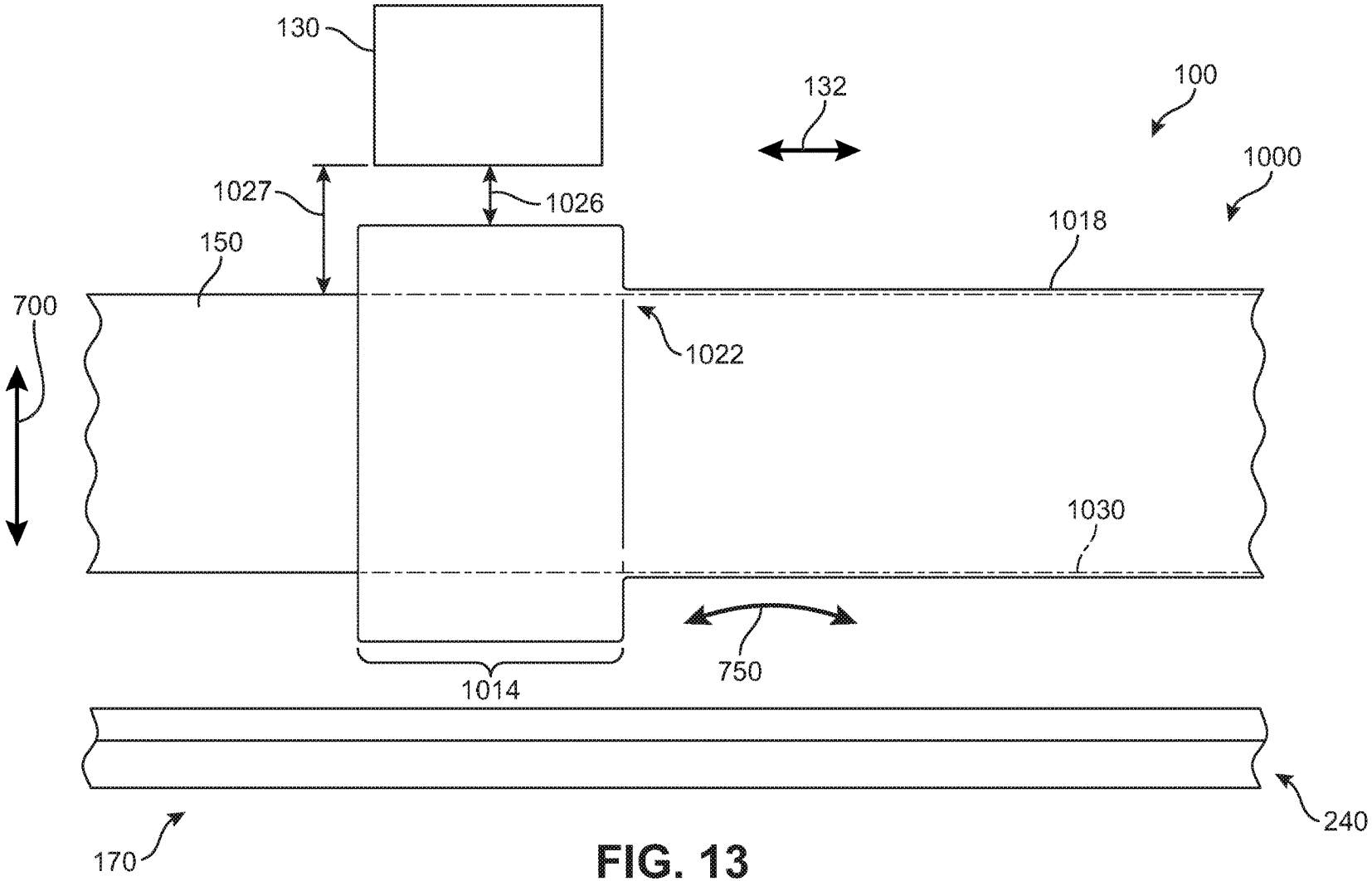
FIG. 13 is a schematic partial view of an embodiment of a printing system in which the printhead traverses along a longitudinal axis.
Figure 14:
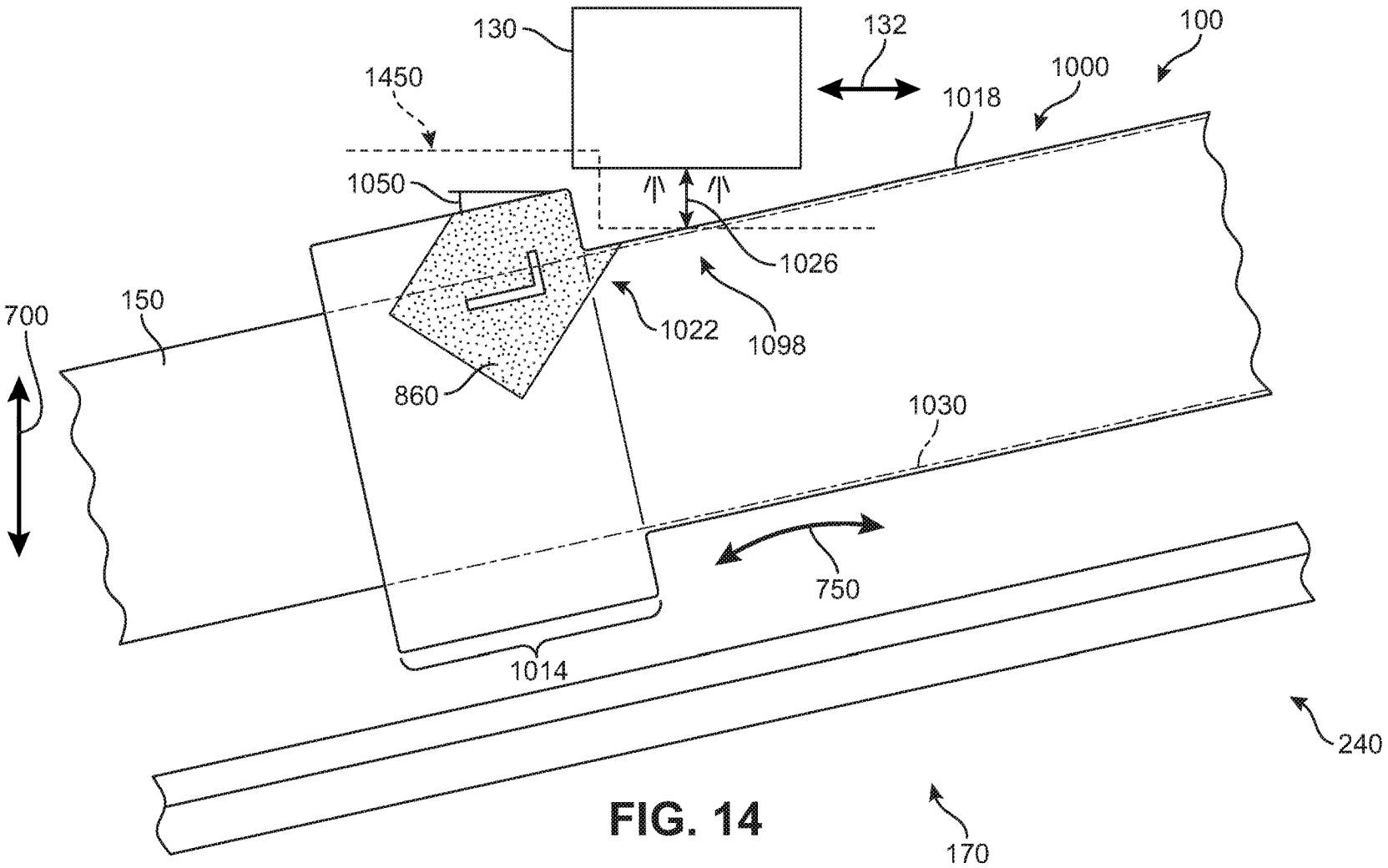
FIG. 14 is a schematic partial view of an embodiment of a printing system in which printing is done on an article of apparel with varying thickness.
Figure 15:
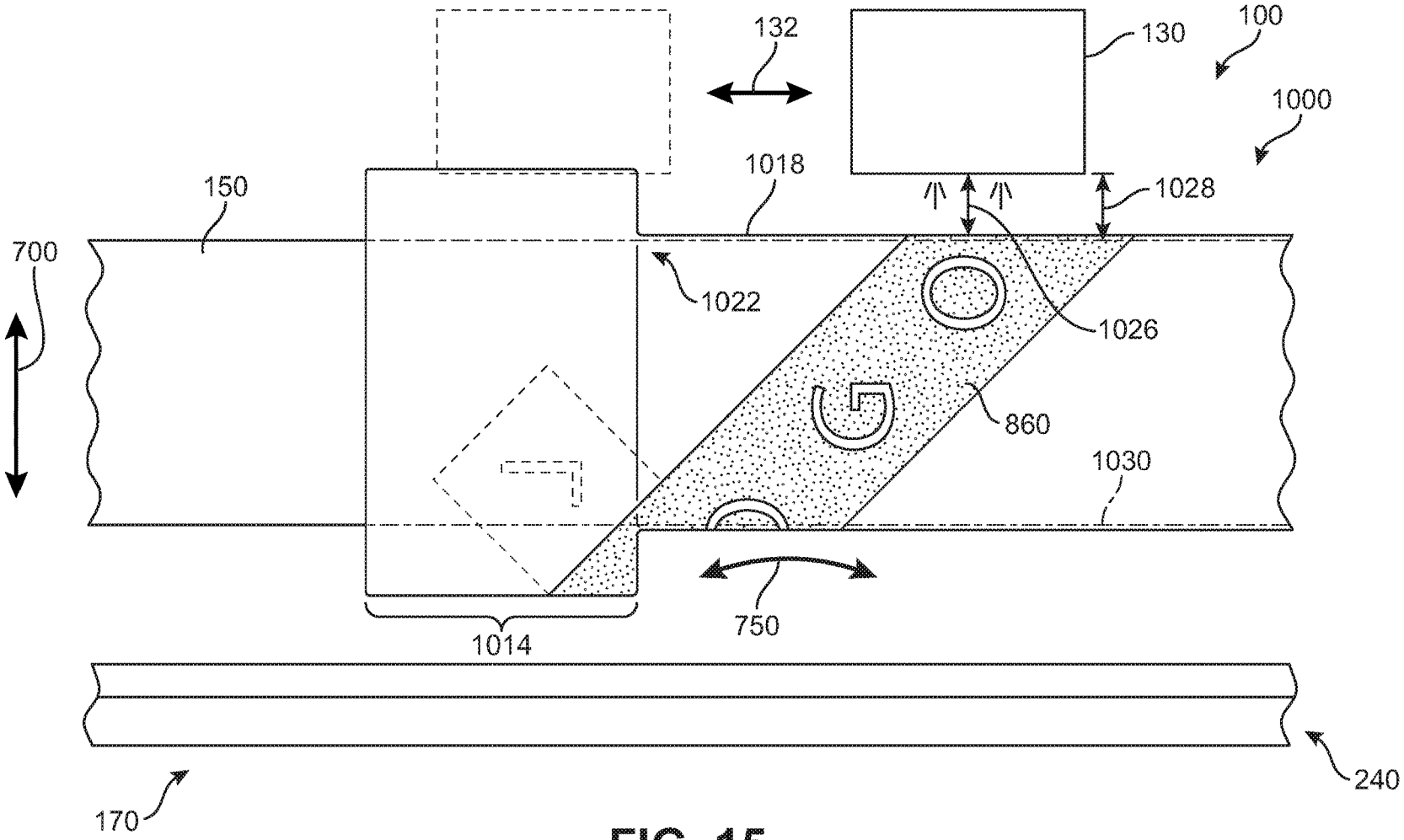
FIG. 15 is a schematic partial view of an embodiment of a printing system in which printing is done on an article of apparel with varying thickness.

FIGS. 13 through 15 illustrate an exemplary sequence in which article receptacle device 150 is tilted along tilting direction 750 to accommodate differences in thickness of article 1000 while maintaining constant distance 1026 between an article's surface to be printed and printhead 130. In some embodiments, article 1000 may be thicker at cuff portion 1014 than at leg portion 1018, therefore, requiring article receptacle device 150 be tilted by article positioning system 170 during printing.

Referring to FIG. 13, printhead 130 is disposed over cuff portion 1014 and has started to print indicia portion 860 (See FIG. 8) onto article 1000. In this position, over cuff portion 1014, article receptacle device 150 has a vertical position such that printhead 130 is spaced apart from cuff portion 1014 by constant distance 1026.

Referring to FIG. 14, in some embodiments, as printhead 130 passes over transition region 1022 between cuff portion 1014 and leg portion 1018, article receptacle device 150 may be tilted along tilting direction 750 such that one longitudinal end is higher than the opposite longitudinal end. More specifically, article receptacle device 150 may be tilted at angle 1050 from a horizontal position such that printhead 130 and the surface of article 1000 are apart by constant distance 1026 near transition region 1022 during printing.

In some embodiments, because article 1000 includes cuff portion 1014 with a different thickness than leg portion 1018, printing system 100 may need to tilt receptacle receiving frame 240 and article receptacle device 150 to avoid printhead 130 contacting the surface of article 1000 as printhead 130 traverses along longitudinal axis 132. Specifically, as seen in FIG. 14, tilting article receptacle device 150 (and article 1000 with it) allows printhead 130 to maintain the desired constant distance 1026 with target printing region 1098 while preventing interference (i.e., contact) between printhead 130 and cuff portion 1014. For purposes of clarity, the un-tilted position 1450 of cuff portion 1014 of article 1000 is shown in FIG. 14 to indicate the potential interference between printhead 130 and cuff portion 1014 that may be avoided by tilting article receptacle device 150. The ability to tilt article receptacle device 150 along tilting direction 750 facilitates a smoother transition between portions having different thicknesses thereby providing the best printing performance.

In FIG. 15, upon passing over transition region 1022, article receptacle device 150 may be tilted back along tilting direction 750 to a horizontal configuration and simultaneously raised along vertical axis 700 by components of article positioning system 170 such that printhead 130 and the underlying portion of article 1000 may be held approximately at constant distance 1026 across portions of article 1000 with different thicknesses and/or geometries.

As printing system 100 continuously prints indicia portion 860 on the surface of article 1000, FIG. 15 illustrates printhead 130 further axially advanced along longitudinal axis 132 in a direction away from cuff portion 1014. From its previous location at cuff portion 1014 of article 1000, printhead 130 traverses along longitudinal axis 132 to its present location around leg portion 1018 of the article 1000 while maintaining constant distance 1026 from FIG. 14.

In some embodiments, while printhead 130 maintains a substantially constant distance 1026 from the surface of article 1000, even when encountering portions of varying thickness or different geometries, registration between printing system 100 components may require a non-fixed distance between printhead 130 and the surface of article receptacle device 150. In some embodiments, the registration between printing system 100 components, article receptacle device 150, circumferential positioning member 400, and article positioning system 170 provide a variable distance between surface 1030 of article receptacle device 150 and printhead 130.

As illustrated in FIGS. 13 and 15, when printhead 130 is disposed over cuff portion 1014, surface 1030 of article receptacle device 150 and printhead 130 are separated by first vertical distance 1027. However, at a later time, when printhead 130 is disposed over leg portion 1018, surface 1030 of article receptacle device 150 and printhead 130 are separated by second vertical distance 1028. Moreover, second vertical distance 1028 is substantially less than first vertical distance 1027, as article 1000 is substantially thinner at leg portion 1018 than at cuff portion 1014. Thus, in relatively thinner portions of article 1000, the vertical separation between article receptacle device 150 and printhead 130 may be closer to the desired constant distance 1026, which is maintained between printhead 130 and the outer surface of article 1000. Thus, given the different thicknesses of different portions of article 1000, the distance between printhead 130 and underlying surface 1030 of article receptacle device 150 may vary substantially, even as printing system 100 maintains constant distance 1026 between printhead 130 and article 1000 during printing for best printing performance.

Once printing has been completed for a specific portion of article 1000 as shown in FIG. 9 step 990, printing system 100 will determine the next target printing region on article 1000 requiring printing as shown in step 992. In some embodiments, the process may then repeat itself until printing is completed on article 1000.

It is to be understood that while the process recited and illustrations shown in FIGS. 9 through 15 was for a single article 1000, second article 1002 loaded on article receptacle device 150 may undergo printing consecutively with, or successively after, article 1000 has been printed with indicia portion 860. In addition, in some embodiments, second article 1002 may not be printed with the same indicia portion 860 but may be printed with totally different markings and designs.

In some embodiments, printing system 100 may print on an article that contains surfaces that are not uniformly horizontal. In some cases, an article may contain surfaces that may not be parallel with longitudinal axis 132. In embodiments where an article's surface is not uniformly horizontal, printing system 100 may need to tilt article receptacle device 150 such that the surface to be printed is substantially horizontal to achieve best printing performance.

Figure 16:
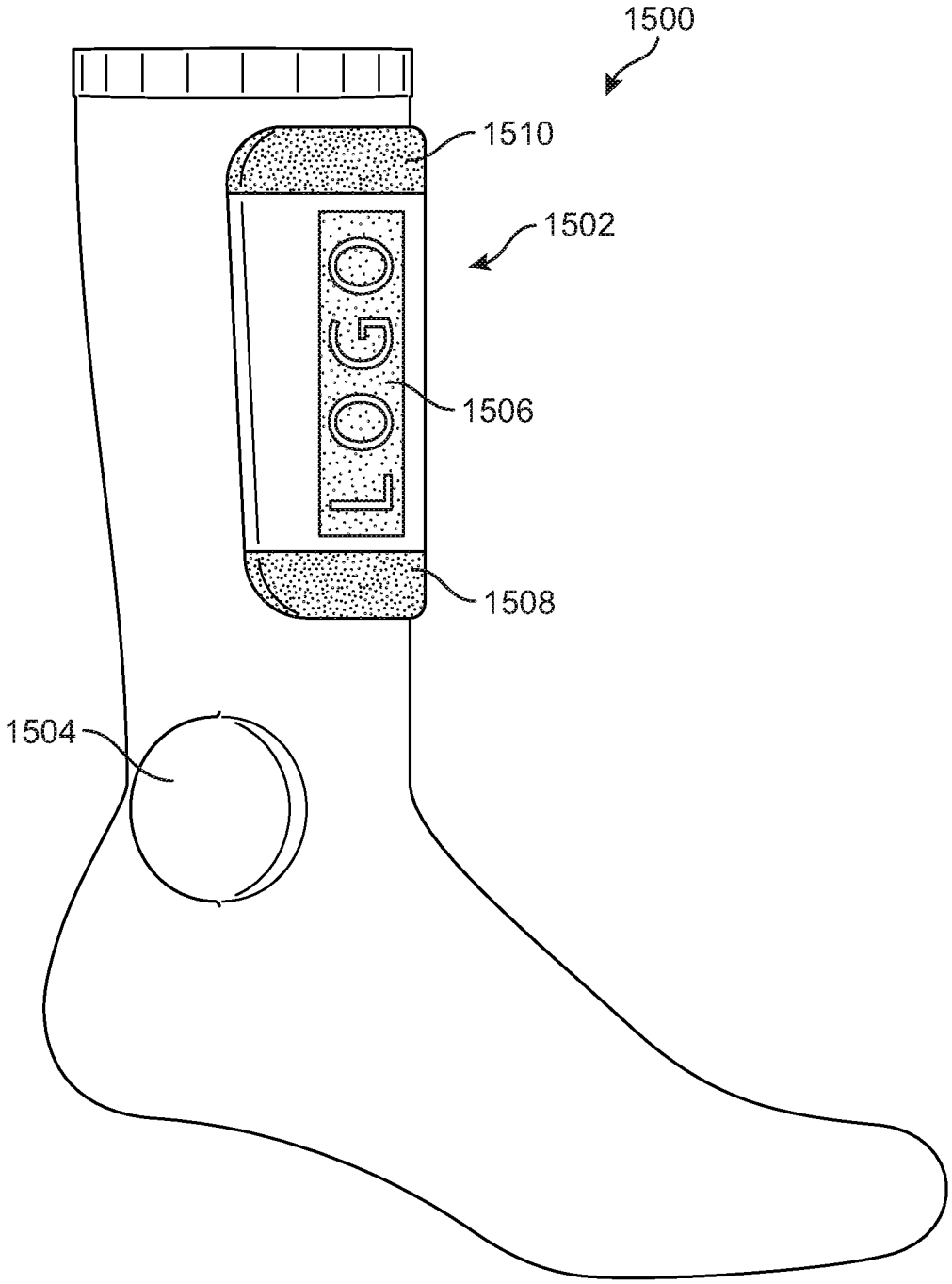
FIG. 16 is a schematic view of an embodiment of an article of apparel having printed indicia portions throughout on surfaces with varying thickness.
Figure 17:
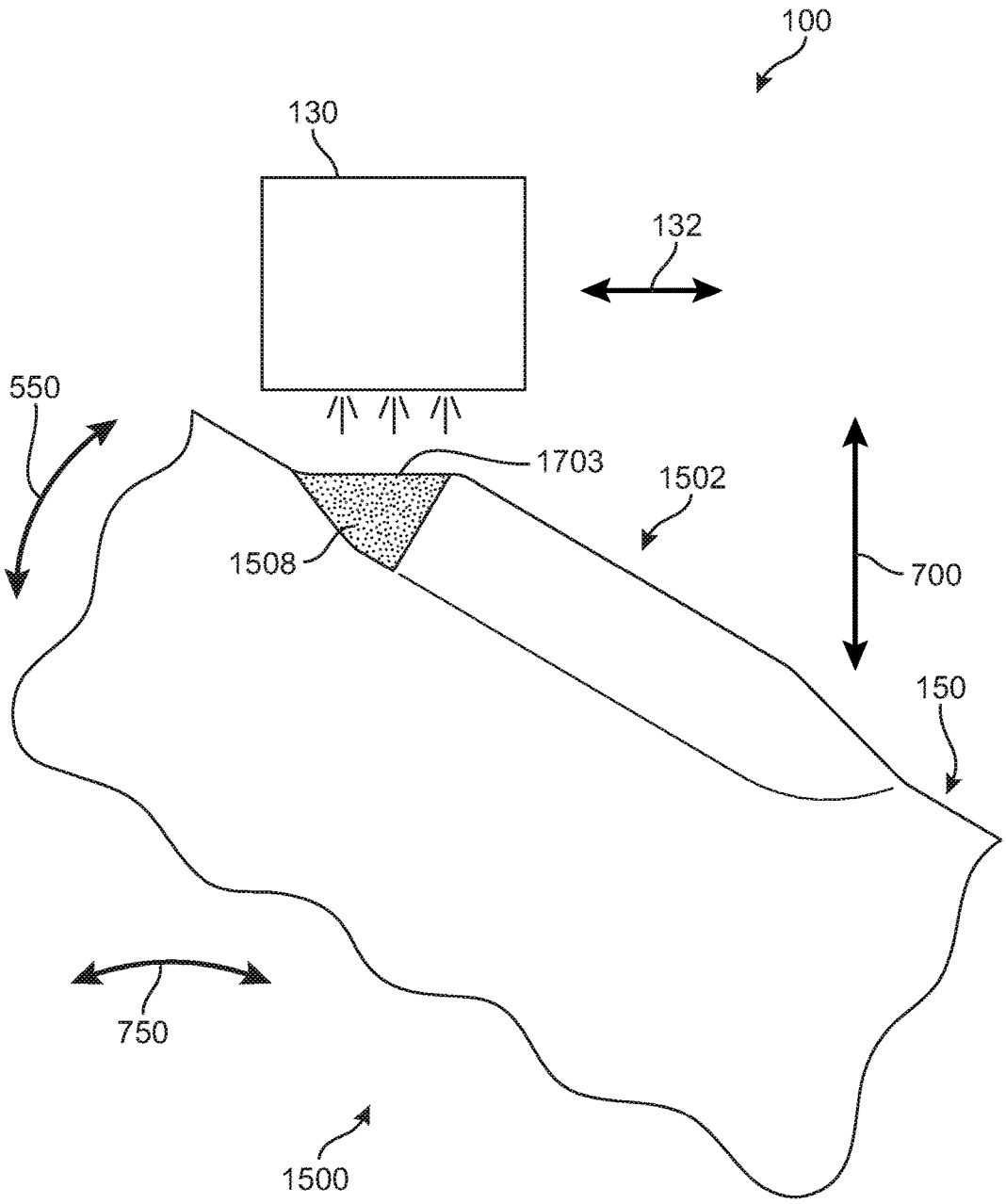
FIG. 17 is schematic partial view of an embodiment of a printing system in which printing is done on an article of apparel with varying thickness.
Figure 18:
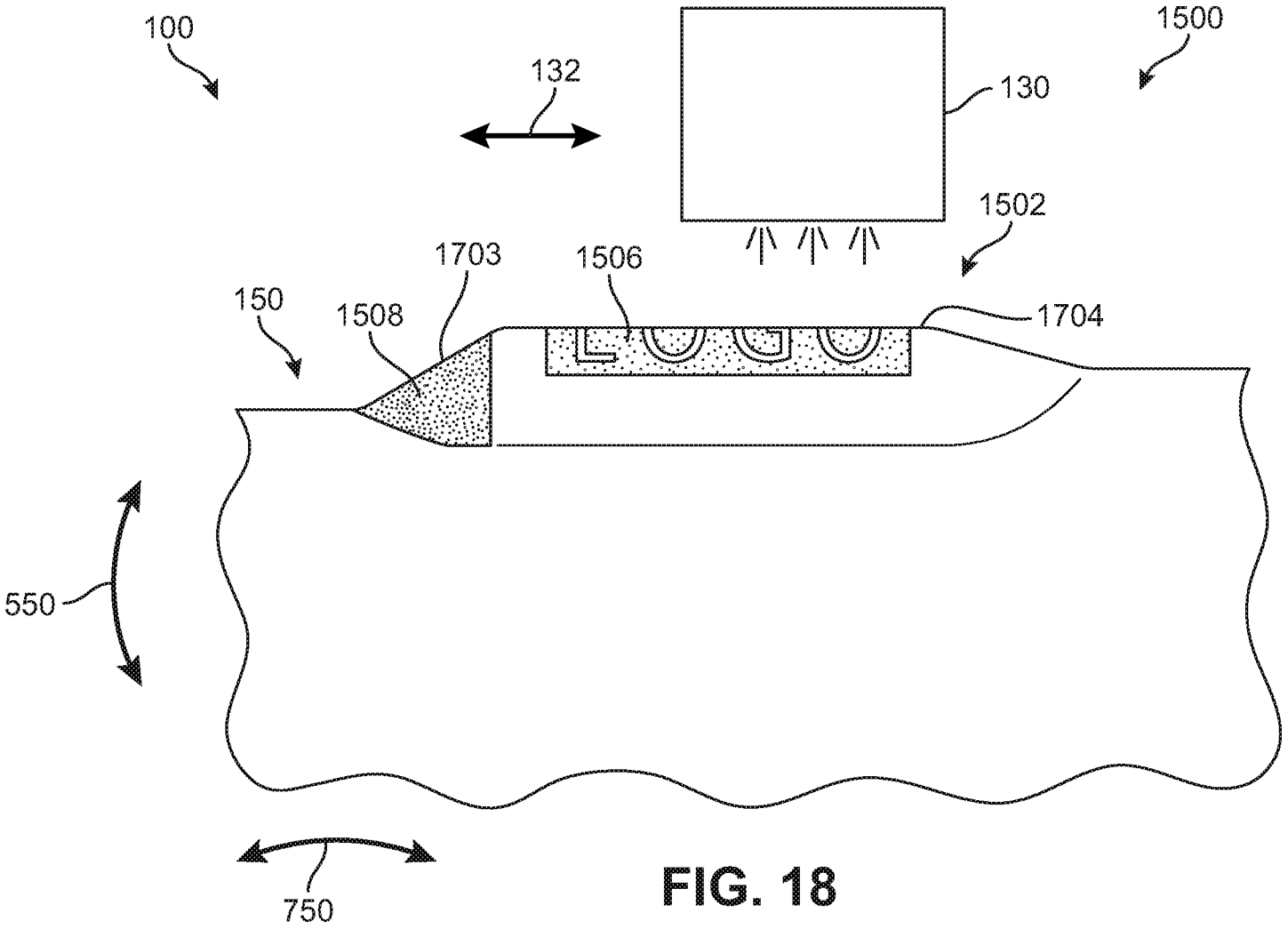
FIG. 18 is a schematic partial view of an embodiment of a printing system in which printing is done on an article of apparel with varying thickness.

FIGS. 16 through 18 depict a resulting embodiment of an exemplary article in the form of sock 1500. In some cases, sock 1500 may include portions having a surface that is not uniformly horizontal or parallel with the surface of article receptacle device 150. Sock 1500 may include portions having various thicknesses along with pockets for placing inserts. In some cases, sock 1500 may include shin padded portion 1502 configured to receive an insert to protect the wearer's shin while engaged in an athletic activity. Shin padded portion 1502 may only partially encompass the circumference of the surface of sock 1500. In still some other cases, other padded portions 1504 may be disposed on other parts of sock 1500.

In some embodiments, shin padded portion 1502 may also have indicia portion 1506. Indicia portion 1506 may only partially encompass the circumference of the surface of sock 1500. In some other embodiments, shin padded portion 1502 may include first design portion 1508. In some embodiments, first design portion 1508 may partially encompass the circumference of sock 1500. In some other cases, second design portion 1510 may be present.

FIGS. 17 and 18 depict an exemplary embodiment of printing system 100 printing indicia portion 1506 and first design portion 1508 on sock 1500. In some embodiments, in order to accommodate the non-horizontal surfaces on shin padded portion 1502, printing system 100 may need to tilt components, by tilting article receptacle device 150 along tilting direction 750, to ensure the surface for printing between printhead 130 and sock 1500 is substantially horizontal. For example, as seen in FIG. 17, article receptacle device 150 (beneath sock 1500) has been rotated so that peripheral surface 1703 of shin padded portion 1502 is approximately parallel with printhead 130. Next, as shown in FIG. 18, article receptacle device 150 has been rotated so that central surface 1704 of shin padded portion 1502 is approximately parallel with printhead 130. Thus, even though peripheral surface 1703 and central surface 1704 are angled with respect to one another, sock 1500 can be continuously tilted during the printing process to ensure that printhead 130 and an underlying surface of sock 1500 are approximately parallel, thereby providing the best printing performance for printing on an article with varying thicknesses and surfaces that are not uniformly horizontal.

In some embodiments, printing system 100 can print on an article, such as a sock, an indicia portion that is continuous. In some other embodiments, printing system 100 can print an indicia portion from one article end to the other article end. In some embodiments, printing system 100 can print along the length of an article with varying thicknesses. In some other embodiments, printing system 100 can print extending around the entirety of a circumference on the article's surface as well.

Figure 19:
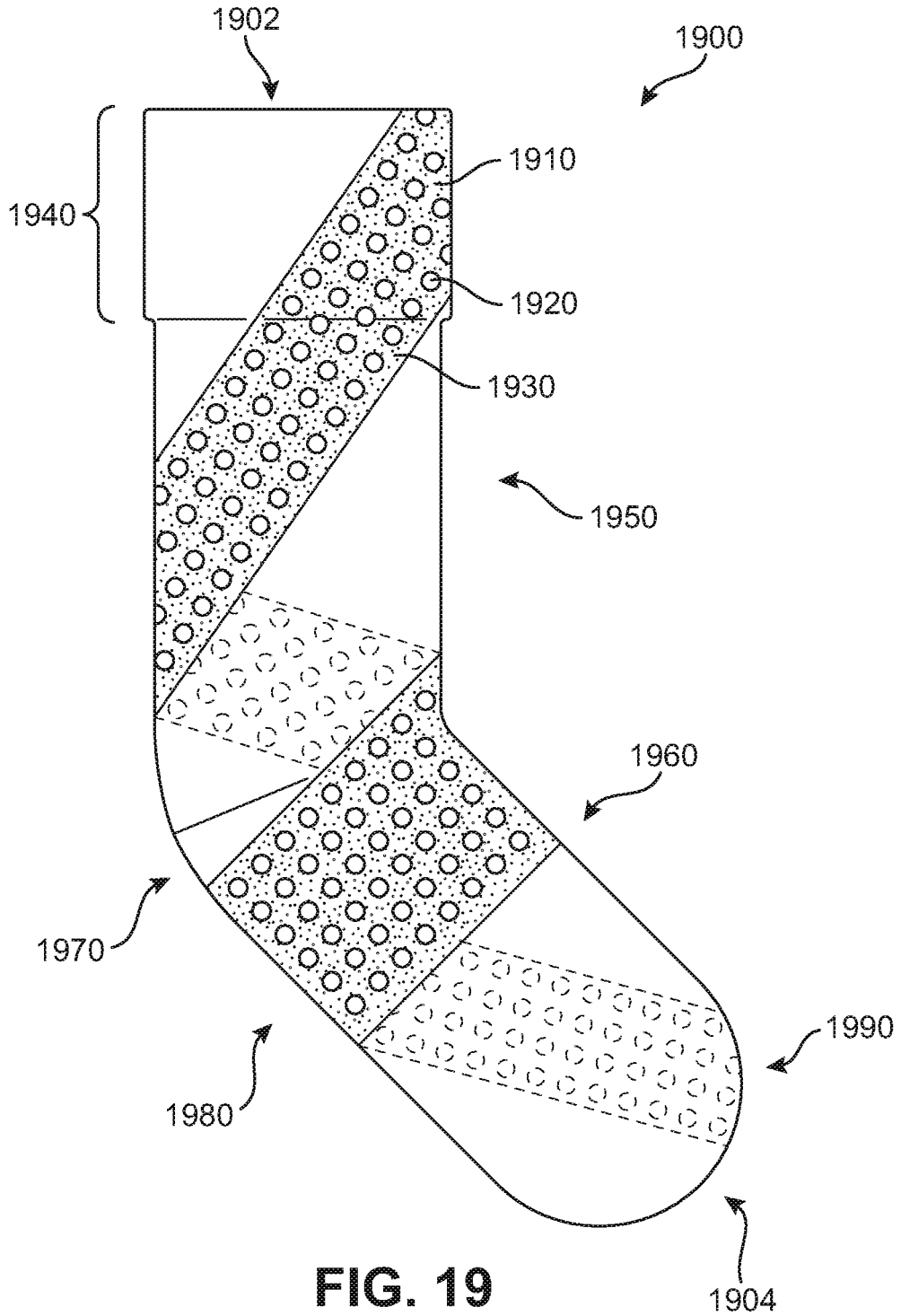
FIG. 19 is a schematic view of an embodiment of an article of apparel having printed indicia portions throughout on surfaces with varying thickness.

FIG. 19 depicts another resulting exemplary article 1900 having first article end 1902 and second article end 1904 similar to articles previously described. In some embodiments, printing system 100 allows for indicia portion 1910 including design portion 1920, background portion 1930, or lettering portion (not shown) to be continuously printed onto article 1900 from first article end 1902 to second article end 1904. In some cases, indicia portion 1910 can be continuously printed along the entire length of article 1900. In some other cases, indicia portion 1910 can be continuously printed around the entirety of the circumference on the surface of article 1900.

In some embodiments, indicia portion 1910 can include cuff portion 1940 having a certain thickness. In some other embodiments, indicia portion 1910 can be continuously printed on leg portion 1950 with a different thickness than cuff portion 1940. In some other embodiments, indicia portion 1910 can be continuously printed on instep portion 1960, heel portion 1970, sole portion 1980, and toe portion 1990, each having different thicknesses.

Figure 20:
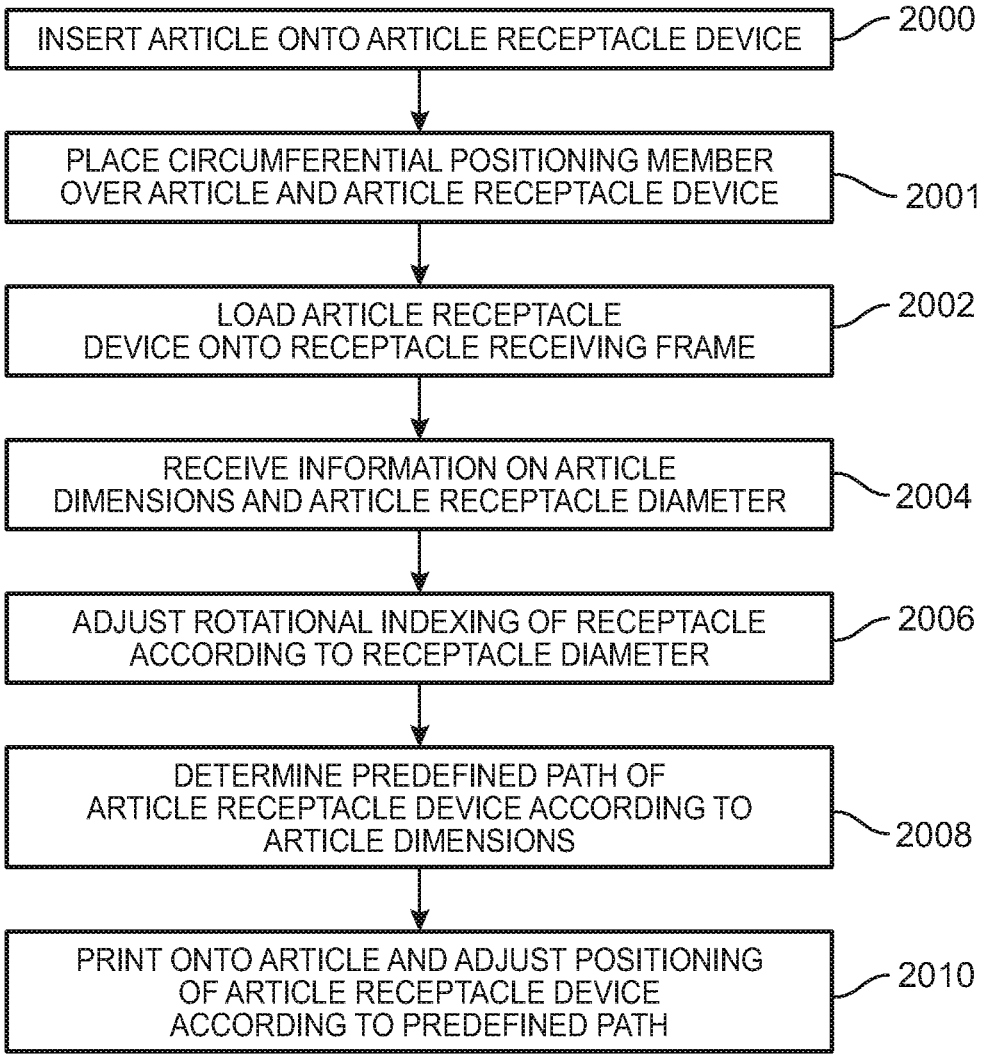
FIG. 20 is an embodiment of a process for printing on an article with varying thickness.

FIG. 20 is an embodiment of another process for printing onto an article using a printing system (e.g., printing system 100). For clarity, the following detailed description discusses an exemplary embodiment, in which printing system 100 is used to print indicia portions to an article, for example a sock.

In some embodiments, some of the following steps may be controlled by a control unit associated with printing system 100. In some other embodiments, these steps may be performed by additional systems or devices associated with printing system 100. For example, for printing systems with sensors or devices for measuring various parameters, one or more steps could be performed by the sensors or devices. In addition, in embodiments where printing system 100 is in communication with a computer (not shown), one or more steps could be performed by the computer. It is also contemplated that some steps of the following process could be accomplished by a user or operator of the system. In addition, it will be understood that in other embodiments, one or more of the following steps may be optional.

During step 2000 in FIG. 20, an article may be inserted onto an article receptacle device having a substantially cylindrical shape. Once the article is mounted and secured onto the article receptacle device, exemplary next step 2001 includes securing the article to the receptacle device. In some embodiments, the article maybe secured by placing a circumferential positioning member over an end of the article. Next, during step 2002, the article receptacle device may be loaded onto the receptacle receiving frame for printing.

At step 2004, a control unit may receive information about the dimensions of the article as well as information about the diameter of the article receptacle device. It may be appreciated that this information could be determined in any manner. In some cases, this information could be determined automatically using one or more sensors. In other cases, the information could be manually inputted into a computing system by a user or operator of the printing system. Moreover, the steps of gathering this information could be accomplished before the article is loaded onto the printing system or after the article has been loaded. In other words, the exemplary ordering of steps shown in FIG. 20 is not intended to be limiting.

Once the diameter of the article receptacle device has been determined, the control unit can automatically adjust the rotational indexing of the receptacle during step 2006. Specifically, the rotational indexing (e.g., how many degrees the receptacle is rotated after each pass of the printhead) may be varied according to the receptacle's (or article's) diameter. As the diameter of the receptacle increases (i.e., one receptacle is replaced by another receptacle with a larger diameter), the receptacle may be rotated through a smaller number of degrees after each printing pass of the printhead. Thus, adjusting for the rotational indexing may help reduce or substantially eliminate banding or other undesirable print effects.

Following step 2006, during step 2008, the control unit may determine a predefined path of the article receptacle device according to the article's dimensions (e.g., article length, thickness at various portions, etc.). As used herein, the term "predefined path" refers to a sequence of one or more parameters in time. For example, a predefined path for an article receptacle device may include a sequence of vertical positions (e.g., positions along a vertical axis) and tilting angles. Thus, for each step in time of the printing system, a particular predetermined vertical position and tilting angle of the receptacle is defined. Moreover, the values of these parameters may be determined to accommodate a corresponding predefined path for a printhead in time, where the predefined path of the printhead in time is a sequence of printhead positions along an axis (e.g., longitudinal axis 132 in FIG. 7). Thus, the predefined path for the receptacle device may be selected so that the printhead is always a desired constant distance from an adjacent printing surface on an article, and so that the printhead never contacts any part of the article.

Finally, during step 2010, the system may print onto the article. During printing, the article receptacle device (and article) may be repositioned according to the predefined path found in step 2008. Thus, as the printhead moves along longitudinal axis 132 to print to various portions of the article, the vertical position and tilt of the article receptacle device can be adjusted according to the predefined path to ensure that a desired printhead to article spacing is maintained and that the printhead doesn't contact any portions of the article.

Figure 21:
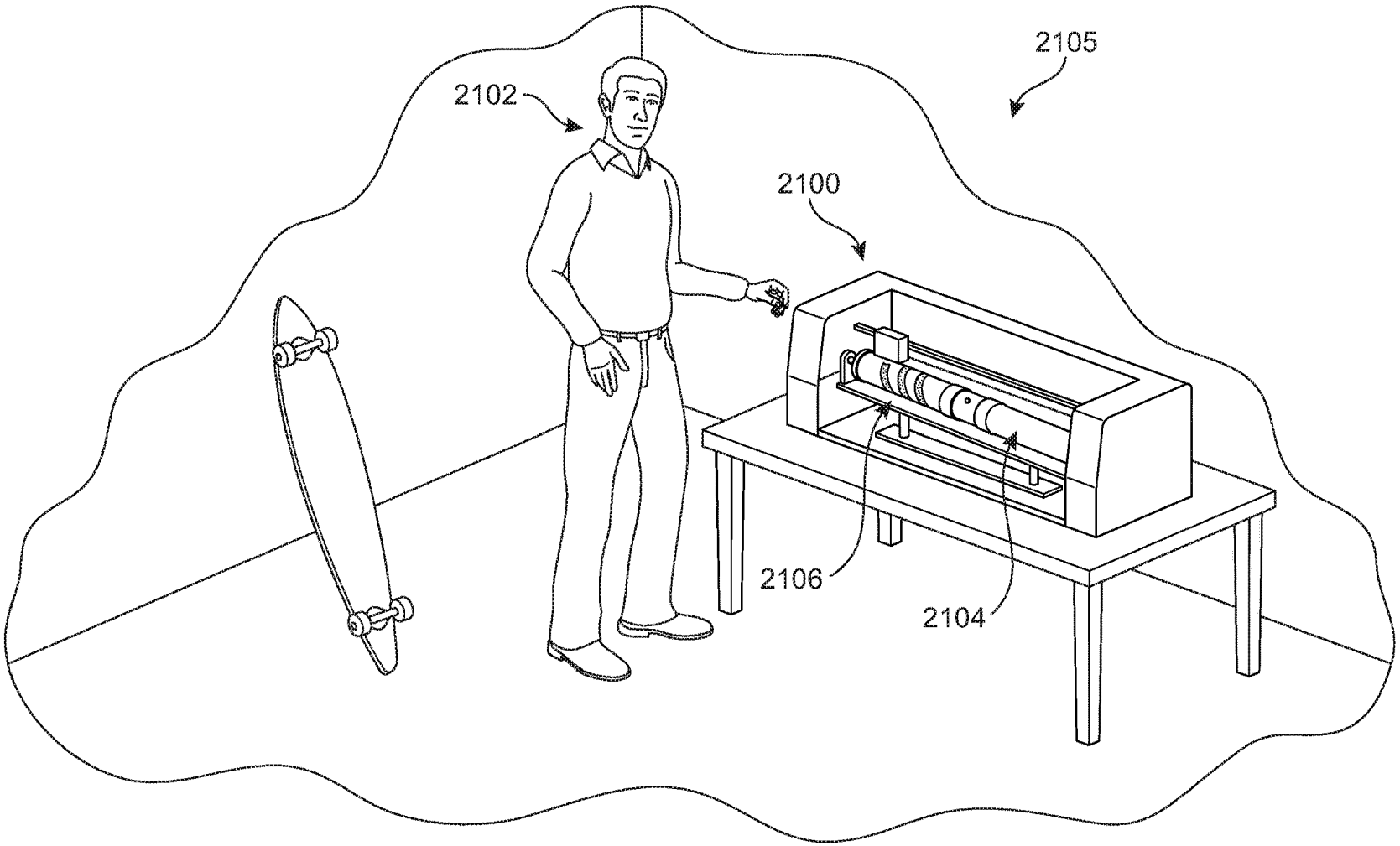
FIG. 21 is an embodiment of a mechanized process directed to printing on an article of apparel.

Some embodiments may be directed to a mechanized process for production of personalized articles of apparel. Referring to FIG. 21, in some embodiments, the process may include printing system 2100 for customizing articles purchased in-store. For example, customer 2102 may decide to purchase articles 2104 and then further wish to have articles 2104 customized with a design or logo. In one embodiment, customer 2102 may enter into any retail store 2105, select and purchase articles 2104, and then place articles 2104 onto printing system 2100. Printing system 2100 will then customize articles 2104 with indicia portion 2106 selected by customer 2102. In some embodiments, sensors or other devices may be used to ensure articles 2104 are properly placed on printing system 2100.

Some embodiments can include provisions for automating one or more steps in the process for production of personalized articles. In some embodiments, a retail employee (not shown) may place non-customized articles in a display case or display table. A customer may enter and inform the retail employee of a specific size for an article to be printed. An automated retrieving device can then be used to retrieve the correct article size and place the article on the printing system for printing.

Figure 22:
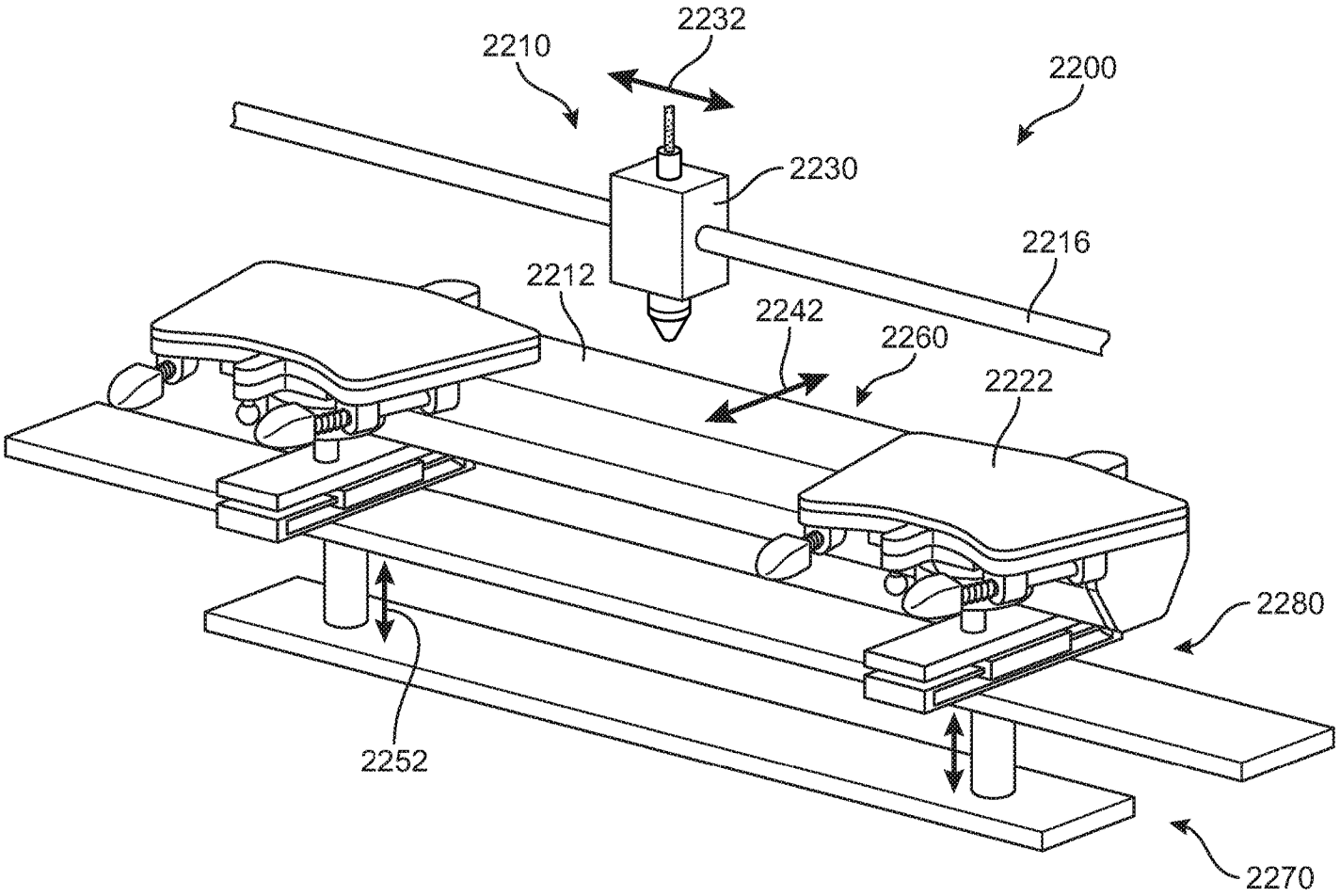
FIG. 22 is a schematic view of an embodiment of a printing system with an article receptacle device.

Referring now to FIG. 22, an alternate embodiment of a printing system is depicted. In the embodiment as depicted, printing system 2200 is comprised of printing assembly system 2210, receptacle receiving system 2260, linear actuating assembly 2280, and article positioning system 2270. In other embodiments, printing system 2200 may include additional provisions such as a housing portion to house the components of printing system 2200. For purposes of illustration, only some components of printing system 2200 are shown in FIG. 22 and described below. Further, in some figures below, components of printing system 2200 may be shown in isolation from other components.

In some embodiments, printing assembly system 2210 includes printhead 2230 for dispersing ink onto an article of apparel. Printhead 2230 may be displaceable along longitudinal direction or longitudinal axis 2232. In other embodiments, it is contemplated that printhead 2230 could be translated in one or more directions that are perpendicular to longitudinal axis 2232 as well. In some cases, longitudinal axis 2232 may generally extend along a longest dimension of printing system 2200. Printing assembly system 2210 may also include a rod, beam, or other device 2216 that allows printhead 2230 to traverse along longitudinal axis 2232.

Some embodiments of printing system 2200 may include provisions to secure an article for printing. In some embodiments, provisions may include an article receptacle device such as platen 2222. In some embodiments, printing system 2200 may utilize different types of article receptacle devices depending on the type of article to be printed. For example, article receptacle devices may have different shapes and sizes to accommodate differently shaped and sized articles. The different types of article receptacle devices that may be used in printing system 2200 will be explained further in detail below.

Some embodiments of printing system 2200 may include components for securing an article receptacle device to printing system 2200. In some embodiments, printing system 2200 may use receptacle receiving system 2260 to secure platen 2222 onto printing system 2200. In some embodiments, with platen 2222 secured to receptacle receiving system 2260, an article can be moved along different axes relative to longitudinal axis 2232. For example, receptacle receiving system 2260 may move along lateral axis 2242. In some embodiments, receptacle receiving system 2260 may have various configurations to secure different types of article receptacle devices. These different configurations of receptacle receiving system 2260 will be explained further in detail below.

Some embodiments may include provisions for moving receptacle receiving system 2260 and platen 2222 along different axes relative to longitudinal axis 2232. In some embodiments, these provisions may move receptacle receiving system 2260 and platen 2222 along lateral axis 2242 that is perpendicular to longitudinal axis 2232. In one embodiment, printing system 2200 is configured with linear actuating assembly 2280 to move along lateral axis 2242. The use of linear actuating assembly 2280 to move receptacle receiving system 2260 and platen 2222 along lateral axis 2242 will be explained further in detail below.

In some embodiments, printing system 2200 may include additional components for moving receptacle receiving system 2260 and platen 2222 along a different axis than lateral axis 2242. In one embodiment, printing system 2200 includes article positioning system 2270. In some embodiments, article positioning system 2270 may include components for moving receptacle receiving system 2260 and platen 2222 along vertical axis 2252 perpendicular to longitudinal axis 2232 and lateral axis 2242. The use of article positioning system 2270 to move receptacle receiving system 2260 and an article receptacle device such as platen 2222 along vertical axis 2252 will be explained further in detail below.

Figure 23:
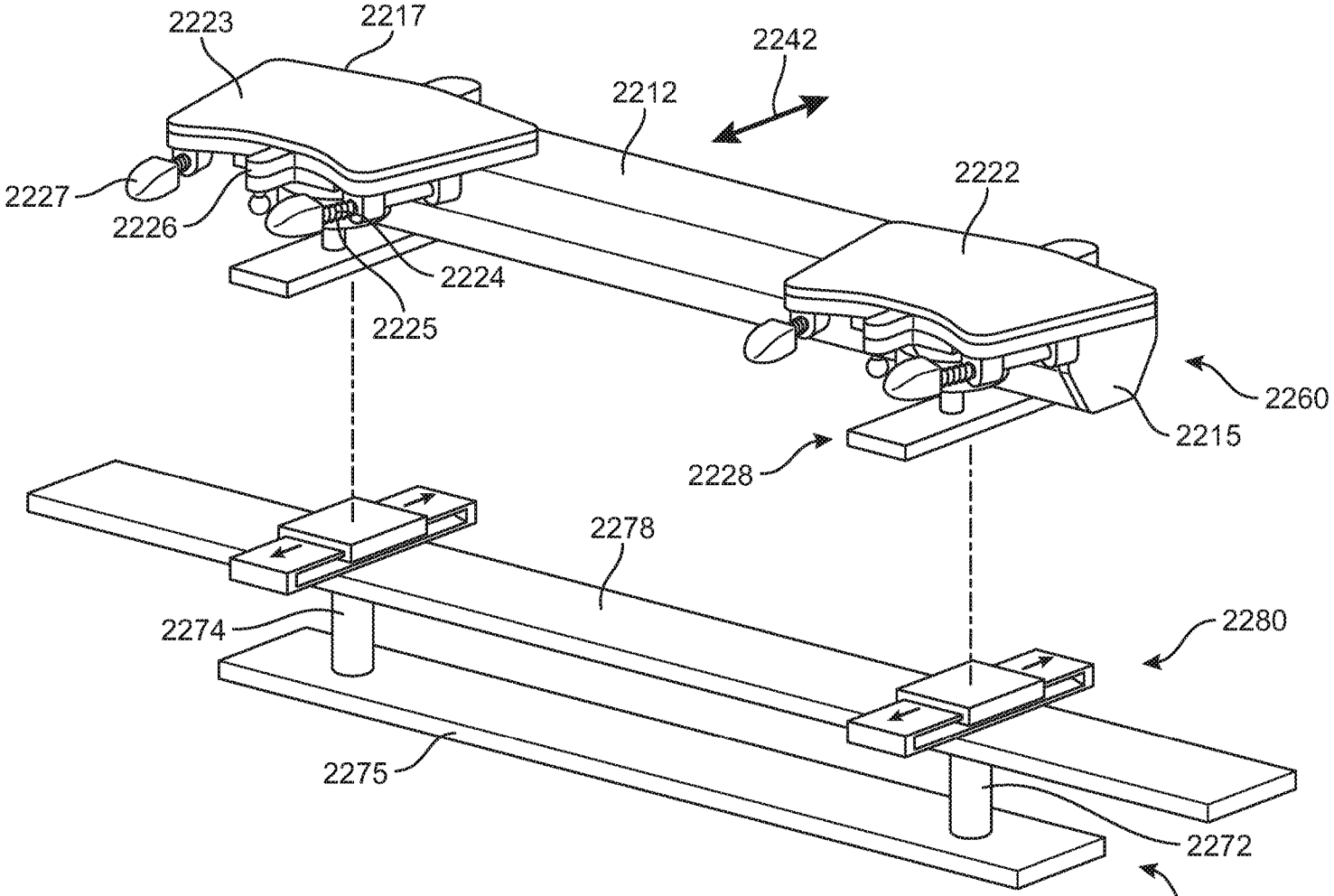
FIG. 23 is a partial exploded view of an embodiment of a printing system.

FIG. 23 illustrates a partial exploded view of some of the components of printing system 2200 as shown in FIG. 22.

Figure 26:
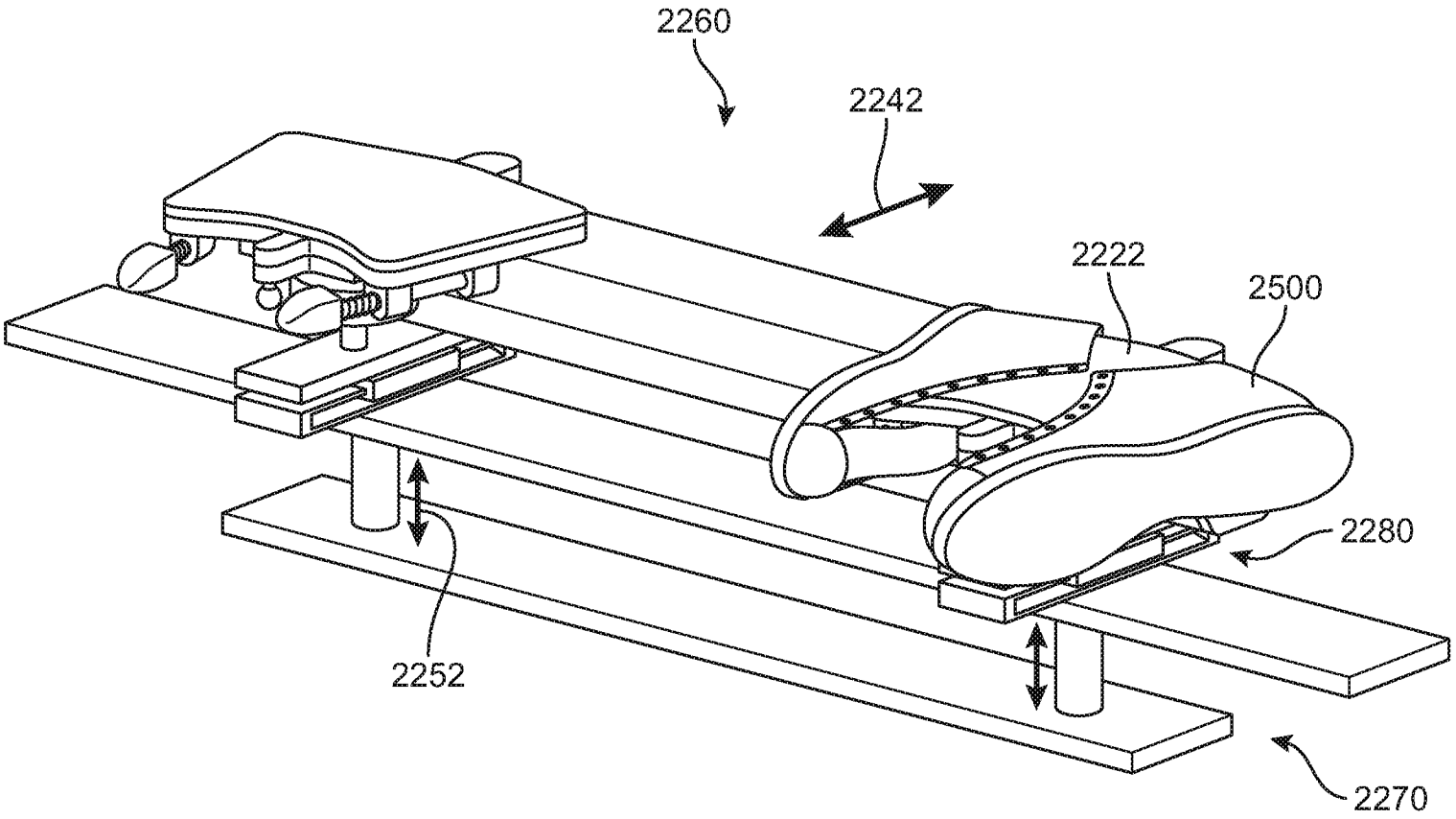
FIG. 26 is a schematic view of an embodiment of a printing system configured with an article of apparel.

Some embodiments may have different configurations and shapes for an article receptacle device, depending on the type of article to be secured. That is, in some embodiments, a different device than platen 2222 may be used to receive an article. In some embodiments, platen 2222 may be used to secure articles having contours or non-planar regions. In one embodiment, platen 2222 may be used to secure articles of footwear (as shown in FIG. 26). Articles of footwear secured to platen 2222 are described in Leedy, U.S. Pat. No. 8,701,733, and entitled "Shoe Customization Having Interchangeable Platens" (referred to hereafter as "Leedy") which is herein incorporated by reference. In some embodiments, second platen 2223 may also be present. As described in Leedy, platen 2222 may include spring 2224, platen rod 2225, protrusion 2226, and piston head 2227 to facilitate the attaching of an article. In some embodiments, platen 2222 may have platen base portion 2228 for securing platen 2222 onto linear actuating assembly 2280. The various portions of platen 2222 may assist in securing an article to platen 2222 as well as secure platen 2222 within printing system 2200. With this arrangement, linear actuating assembly 2280 may move platen 2222 along lateral axis 2242 during operation.

In some embodiments, receptacle receiving system 2260 may have different geometries and configurations. In some embodiments, receptacle receiving system 2260 may be configured to receive an article receptacle device in the form of platen 2222. In this embodiment, receptacle receiving system 2260 is comprised of elongated structure 2212 (also see FIG. 22) with a substantially trapezoidal cross section as shown in FIG. 23. The cross-sectional shape of elongated structure 2212 is clearly shown at first receptacle end 2215, that is opposite of second receptacle end 2217 (not visible). Elongated structure 2212 may be so dimensioned along its length and width to accommodate more than a single article receptacle device. In other embodiments, receptacle receiving system 2260 may have a different structure and configuration.

In some embodiments, article positioning system 2270 may be used to position an article receptacle device such as platen 2222 closer to or farther away from printing assembly system 2210 during operation. Article positioning system 2270 may have many similar characteristics to article positioning system 170 as discussed previously. For example, in some cases, article positioning system 2270 may include first article positioning member 2272 similar in function to first article positioning member 252 of printing system 100. First article positioning member 2272 may be used to enable movement of article positioning shelf 2278 in a linear direction along vertical axis 2252. In some embodiments, second article positioning member 2274 may be included to enable movement of article positioning shelf 2278 in a linear direction independent from first article positioning member 2272. That is, in some embodiments, first article positioning member 2272 may extend a larger distance than second positioning member 2274 and orient positioning shelf 2278 at an angle relative to longitudinal axis 2232. In some cases, first article positioning member 2272 and second article positioning member 2274 may be attached to article positioning shelf 2278. In other embodiments, article positioning shelf 2278 may be absent, and first article positioning member 2272 and second article positioning member 2274 may be directly attached to linear actuating assembly 2280.

In some embodiments, article positioning system 2270 may also include article positioning base 2275. Article positioning base 2275 may be placed underneath first article positioning member 2272 and/or second article positioning member 2274 for increased stability during printing operation.

Figure 24:
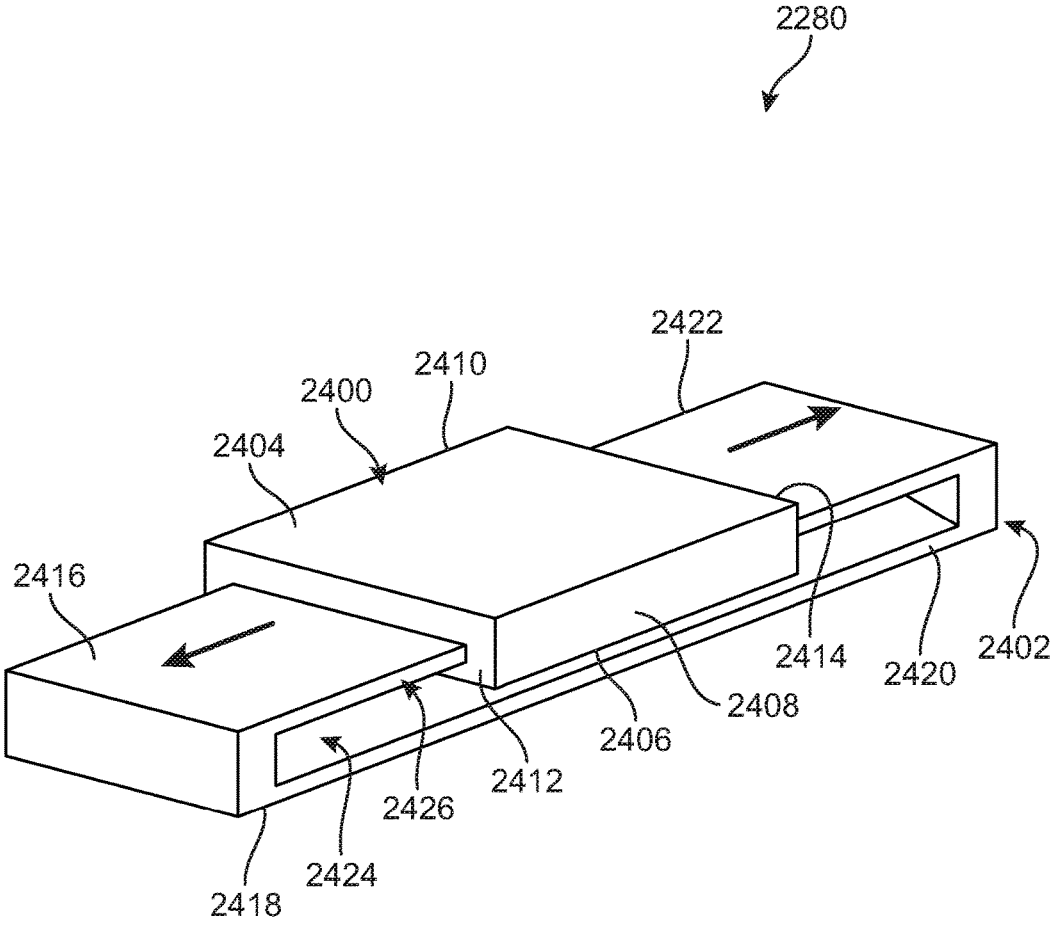
FIG. 24 is a schematic view of an embodiment of linear actuating assembly.

FIG. 24 illustrates a schematic isolated view of linear actuating assembly 2280. In some embodiments, linear actuating assembly 2280 may use linear actuators known in the art. In some embodiments, linear actuating assembly 2280 is comprised of carriage member 2400 and linear base member 2402. In one embodiment, carriage member 2400 includes top face or platform 2404 upon which receptacle receiving system 2260 and/or an article receptacle device may rest. Carriage member 2400 may also include bottom face 2406 opposite platform 2404. Carriage member 2400 may further include first carriage side face 2408 disposed between platform 2404 and bottom face 2406 along a vertical plane. Second carriage side face 2410 opposite first carriage side face 2408 may also be present. Finally, carriage member 2400 may include front face 2412 and opposite rear face 2414. Both front face 2412 and opposite rear face 2414 may be disposed between platform 2404, bottom face 2406, first carriage side face 2408, and second carriage side face 2410.

In some embodiments, carriage member 2400 may be configured to move or slide along top surface 2416 of linear base member 2402. Linear base member 2402 may include bottom surface 2418 located opposite top surface 2416. Linear base member 2402 may also include first side face 2420 and second side face 2422 disposed between top surface 2416 and bottom surface 2418. In some embodiments, first side face 2420 and second side face 2422 may have openings 2424 to allow carriage member 2400 to rest onto linear base member 2402. In some embodiments, openings 2424 may form guide portions 2426 to facilitate carriage member 2400 moving along top surface 2416 of linear base member 2402.

In some embodiments, linear actuating assembly 2280 may be positioned between receptacle receiving system 2260 and article positioning system 2270. In some embodiments, bottom surface 2418 of linear base member 2402 is positioned above an article positioning device such as article positioning shelf 2278. In some embodiments, platform 2404 of carriage member 2400 underlies and is secured to components of platen 2222. In some other embodiments, platform 2404 may be configured and secured to receptacle receiving system 2260. In such configurations, as carriage member 2400 moves laterally along linear base member 2402, so too will receptacle receiving system 2260 along with platen 2222.

Figure 25:
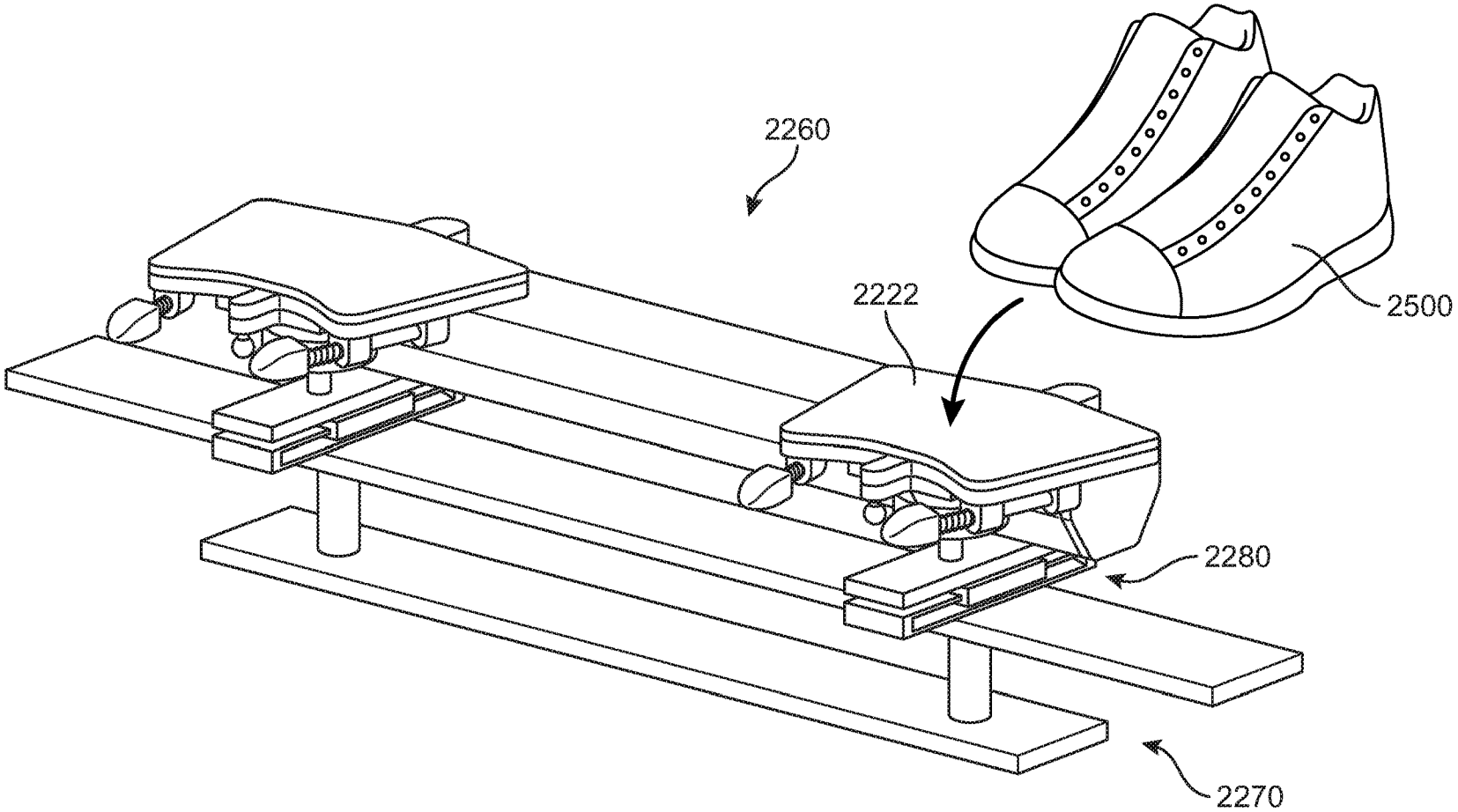
FIG. 25 is a schematic view of an embodiment of a printing system with an article of apparel.

Referring to FIG. 25, in some embodiments, an article receptacle device such as platen 2222 may secure different types of articles of apparel for printing. In some embodiments, article of footwear 2500 may be secured onto platen 2222. In an exemplary embodiment, article of footwear 2500, also referred to hereafter simply as article 2500, is shown in the form of an athletic shoe. In other embodiments, however, platen 2222 may be configured with any other kind of footwear including, but not limited to, hiking boots, soccer shoes, football shoes, sneakers, running shoes, cross-training shoes, rugby shoes, basketball shoes, baseball shoes as well as other kinds of shoes. Moreover, in some embodiments, article 2500 may be configured for use with various kinds of non-sports-related footwear, including, but not limited to, slippers, sandals, high-heeled footwear, loafers as well as any other kinds of footwear. As discussed in further detail below, an article receptacle device may not be limited to accept footwear, and in other embodiments an article receptacle device could be configured to accept various kinds of apparel, including clothing, sportswear, sporting equipment and other kinds of apparel.

Figure 27:
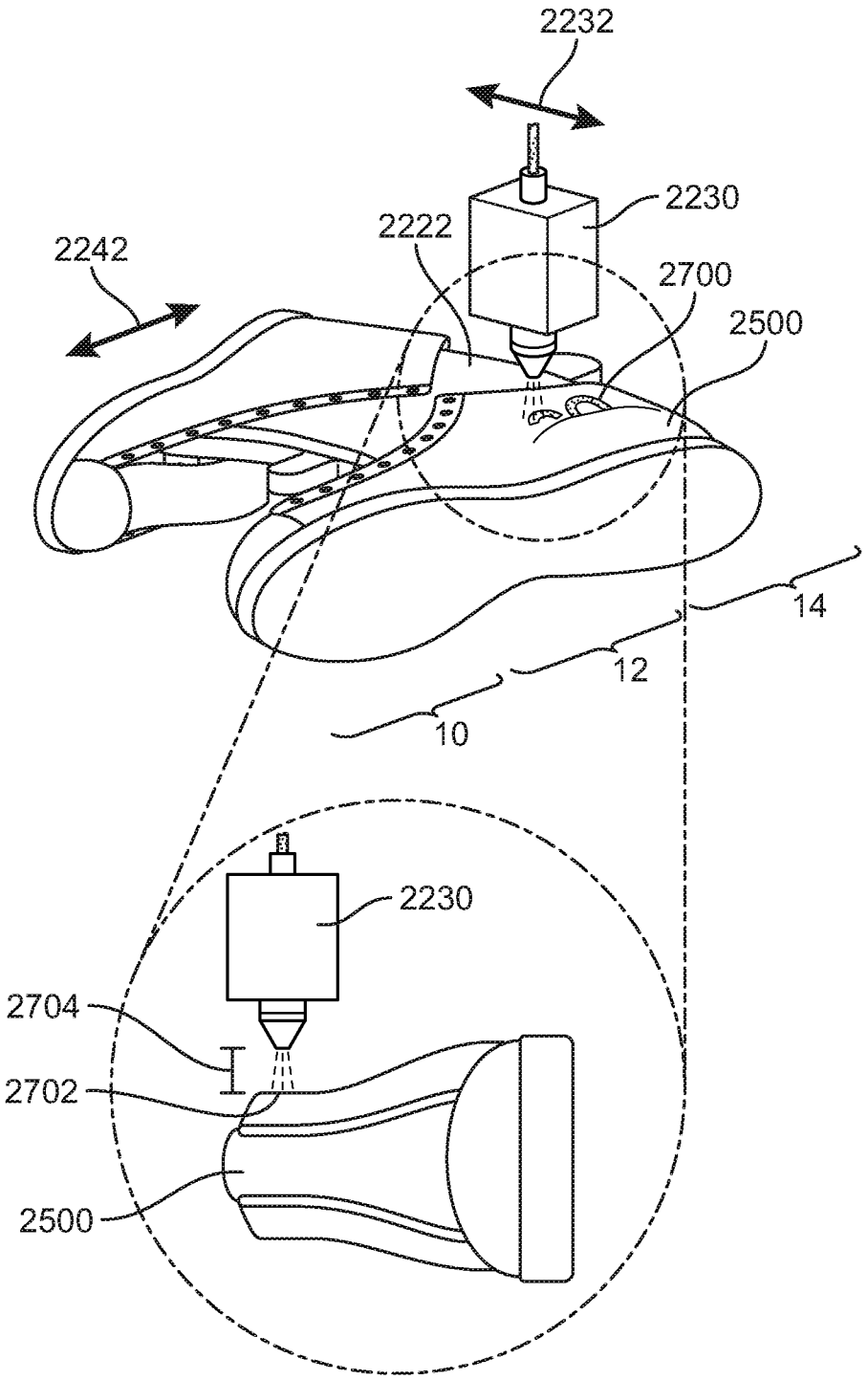
FIGS. 27 and 28 is a partial schematic close-up view of a printing system printing on an article of apparel having contours.
Figure 28:
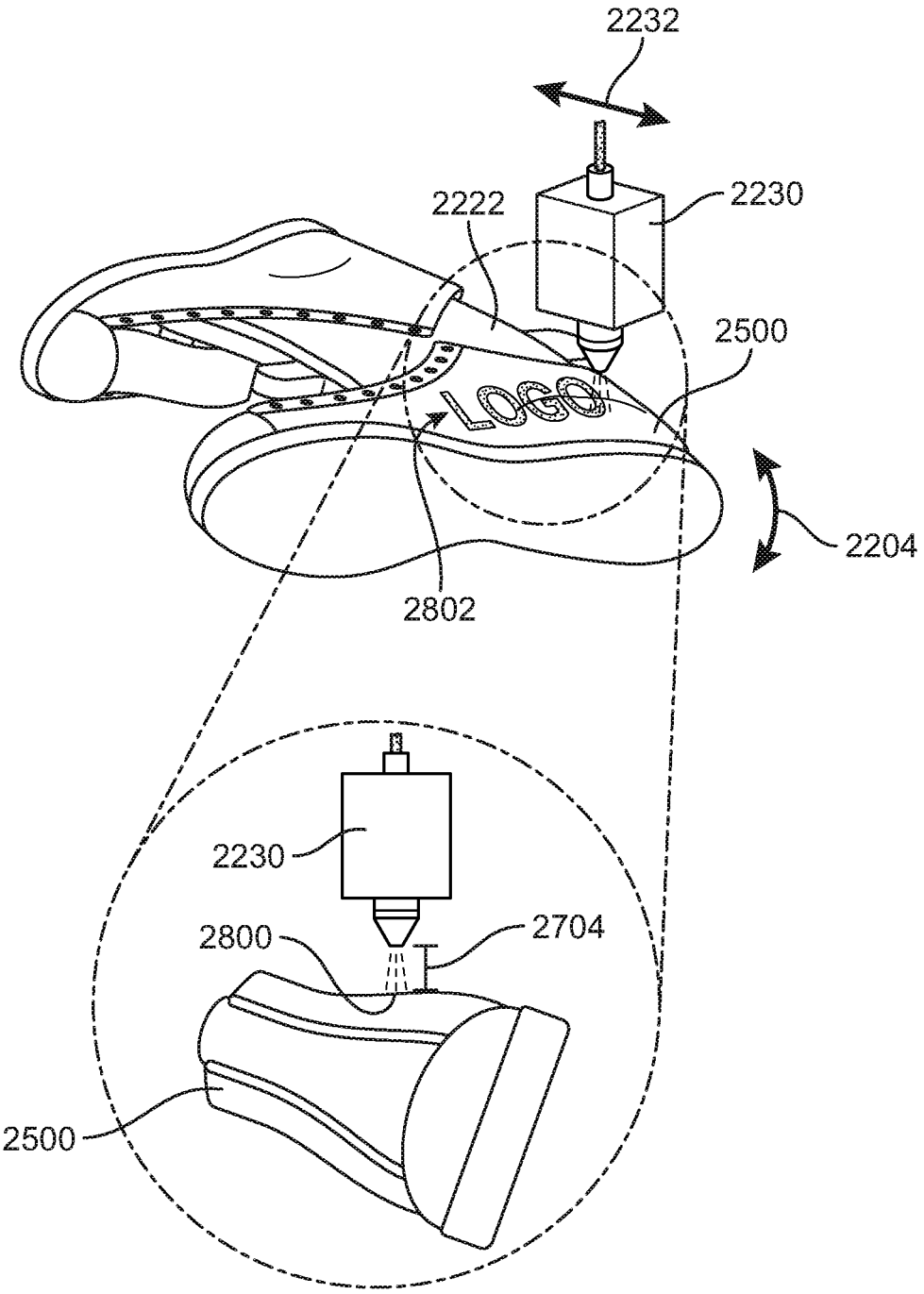

FIGS. 26-28 illustrate an exemplary situation where an article has portions with generally non-planar areas such as contours or bulges, and where it may be necessary to tilt and/or adjust a vertical position of receptacle receiving system 2260 and platen 2222 during operation. Further, FIGS. 26-28 depict an article that includes different lateral dimensions along the length of the article. The lateral movement of receptacle receiving system 2260 along with platen 2222 may assist in positioning various areas of an article to be printed upon. Referring to FIG. 26, in some embodiments, article 2500 may be secured onto platen 2222 and receptacle receiving system 2260 for printing. As previously stated, linear actuating assembly 2280 may move receptacle receiving system 2260 and platen 2222 along lateral axis 2242. Further, article positioning system 2270 may move receptacle receiving system 2260 and platen 2222 along vertical axis 2252. Lateral axis 2242 and vertical axis 2252 are perpendicular to longitudinal axis 2232.

FIGS. 27 and 28 illustrate an exemplary sequence in which article 2500 (configured on platen 2222) has indicia portion 2700 printed on its surface. Indicia portion 2700, as used in this detailed description and in the claims, can refer to both singular and a plurality of markings created from the dispersion of ink from printhead 2230 onto article 2500.

Referring to FIG. 27, printhead 2230 is disposed over non-contour portion 2702 and has started to print indicia portion 2700 on article 2500. As explained above, printhead 2230 traverses along longitudinal axis 2232 during operation. However, because printing system 2200 includes linear actuating assembly 2280 (shown in FIG. 26), printhead 2230 can thus deposit ink on article 2500 along lateral axis 2242 perpendicular to longitudinal axis 2232. For example, platen 2222 may move along lateral axis 2242 so that indicia portion 2700 may be formed in heel region 14. However, as shown, portions of indicia portion 2700 may extend toward midfoot region 12 and forefoot region 10 of article 2500. The ability of receptacle receiving system 2260 to move laterally allows for multiple areas of article 2500 to be printed upon. Unlike article 1000 discussed previously, the rotation of article 2500 about an axis parallel to longitudinal axis 2232 may not be sufficient to allow for various portions of article 2500, such as forefoot region 10, to be printed upon with accuracy. By providing receptacle receiving system 2260 the ability to translate laterally, a constant distance from printhead 2230 to article 2500 may be achieved throughout the printing process.

Referring to the enlarged view in FIG. 27, as printhead 2230 is positioned over non-contour portion 2702, article 2500 has a horizontal position and a vertical position such that printhead 2230 is spaced apart from non-contour portion 2702 by constant distance 2704. It is to be noted that some components of printing system 2200 are shown in isolation from other components for purposes of clarity.

Referring to FIG. 28, in some embodiments, as printhead 2230 passes over to contour portion 2800 of article 2500, article positioning system 2270 may lower first receptacle end 2215 of receptacle receiving system 2260 such that first receptacle end 2215 (and accordingly platen 2222 disposed at first receptacle end 2215) is lower than second receptacle end 2217 (See FIG. 23). In other words, in some embodiments, article 2500 may be tilted at an angle from a horizontal position such that printhead 2230 and contour portion 2800 are apart by constant distance 2704 during operation.

In some embodiments, the tilting of article 2500 on platen 2222 by article positioning system 2270 enables printhead 2230 to avoid contacting the surface of article 2500 as printhead 2230 traverses along longitudinal axis 2232. As seen in FIG. 28, tilting platen 2222 (and article 2500) allows printhead 2230 to maintain the desired constant distance 2704 with a desired printing region 2802 while preventing interference or contact between printhead 2230 and contour portion 2800. The ability to tilt platen 2222 along tilting direction 2204, as printhead 2230 traverses along longitudinal axis 2232 and as platen 2222 is actuated along lateral axis 2242, facilitates a smoother transition between portions having different contours, thereby providing an improved printing performance over other embodiments.

Additionally, as depicted in FIGS. 27 and 28, article 2500 may not have a constant or consistent cross section. In contrast to article 1000, therefore, a rotation of article 2500 may not allow for all areas of article 2500 to be printed upon. By providing a mechanism that allows article 2500 to move laterally, the printing region may not be limited by the shape of the article. Rather, the article may be translated to be positioned at a constant distance away from printhead 2230 to provide an accurate and consistent printing performance.

Figure 29:
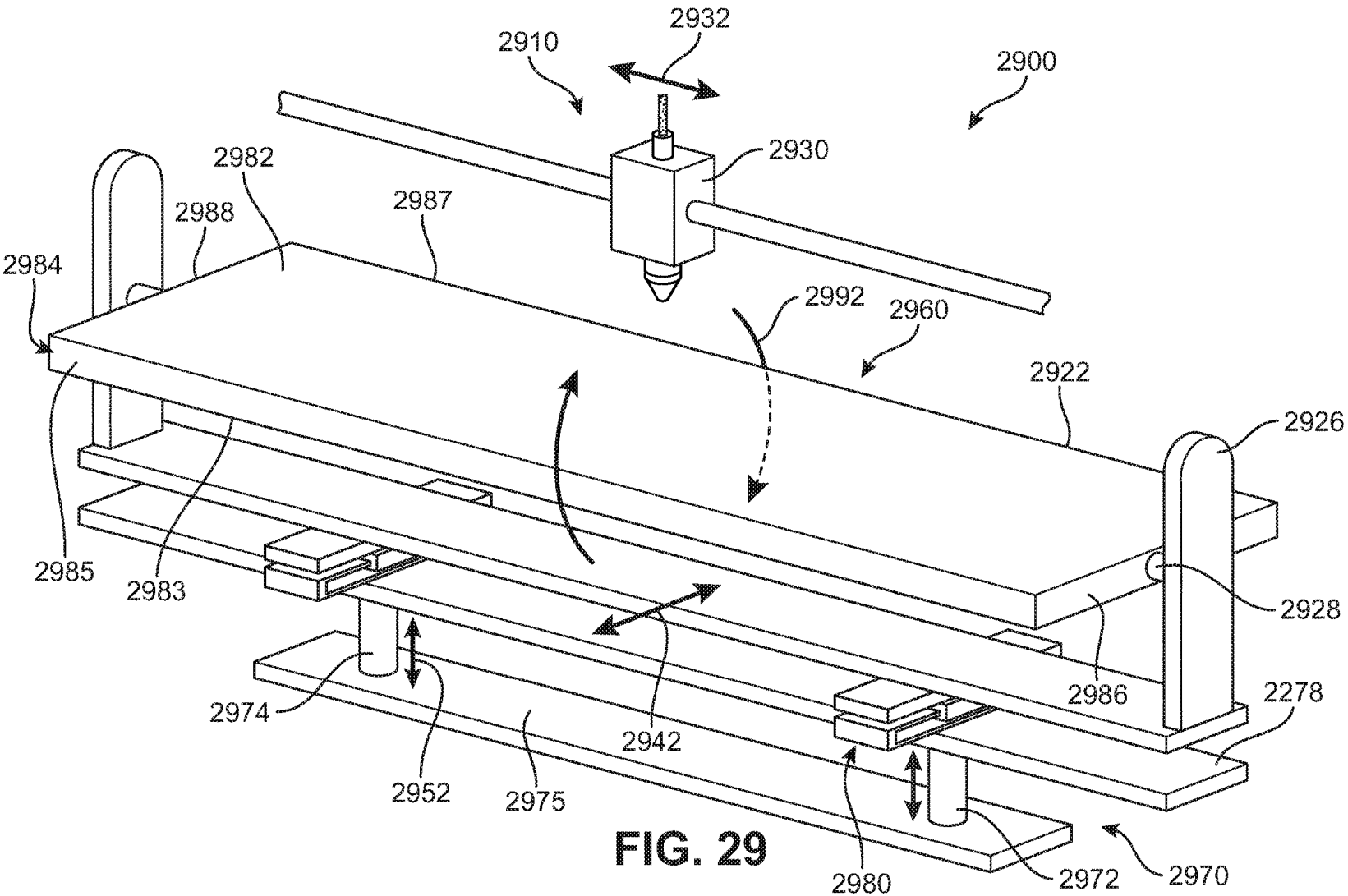
FIG. 29 is a schematic view of an embodiment of a printing system with an alternate type of article receptacle device.

Other embodiments may include provisions for printing upon various different types of articles. In some embodiments, articles may have different shapes, sizes, and geometry, which may require different types of article receptacle devices used by the printing system. Referring to FIG. 29, a schematic view of another embodiment of printing system 2900 with a different article receptacle device than previously disclosed is illustrated.

In some embodiments, an article receptacle device may be in the form of plank 2922. Plank 2922 may have a variety of sizes and shapes depending on the articles to be printed upon. In some embodiments, plank 2922 may be used to secure articles that have a substantially flat, elongated, and rectangular geometry.

In some embodiments, plank 2922 may be secured to receptacle receiving system 2960 by connecting aperture 2924 (shown in FIG. 30) disposed at either end of plank 2922. Connecting aperture 2924 may be used to attach plank 2922 to vertical support component 2926 of receptacle receiving system 2960. In some embodiments, receptacle receiving system 2960 may be similar to receptacle receiving system 2260 described above. In other embodiments, receptacle receiving system 2960 may include vertical support component 2926. In one embodiment, vertical support component 2926 may include alignment receiving portion 2928, which engages aperture 2924 to connect plank 2922 with receptacle receiving system 2960.

In some embodiments, plank 2922 may comprise of first surface 2982 proximal to printhead 2930. Plank 2922 may also include second surface 2983 opposite first surface 2982 and distal to printhead 2930. Plank 2922 may further include plurality of vertical surfaces 2984 perpendicular to first surface 2982 and second surface 2983 and disposed between first surface 2982 and second surface 2983. In one embodiment, plank 2922 may include first vertical surface 2985, second vertical surface 2986, third vertical surface 2987, and fourth vertical surface 2988. As shown in FIG. 29, plurality of vertical surfaces 2984 may share a plurality of common edges with first surface 2982 and second surface 2983.

In some embodiments, the positioning of alignment receiving portion 2928 on vertical support component 2926 enables plank 2922 to be rotated about a rotational direction. As shown in FIG. 29, the connection of alignment receiving portion 2928 with connecting aperture 2924 creates a coupling that supports the rotation of plank 2922 about rotational direction 2992. More specifically, rotational direction 2992 corresponds to the rotational direction along a central axis of plank 2922 through which plank 2922, and any article disposed on plank 2922, may rotate. In some cases, rotational direction 2992 may be defined about a central longitudinal axis of plank 2922. However, in other cases, rotational direction 2992 could be defined about the central axis of another component.

Similar to the discussion above, in some embodiments, printing system 2900 may include provisions for moving an article receptacle device in more than one direction. During operation, a printhead may traverse along a longitudinal axis. In some embodiments, a printing system may include provisions that allow an article receptacle device to move in a vertical direction perpendicular to the longitudinal axis. Some embodiments may also include provisions for moving an article receptacle device in a lateral direction that is perpendicular to the longitudinal axis.

Referring to FIG. 29, in some embodiments, printing system 2900 may include article positioning system 2970 that can be used to move plank 2922 closer to or farther away from printhead assembly 2910 during operation. Article positioning system 2970 may be similar to article positioning system 2270 described above. In some cases, article positioning system 2970 may include first article positioning member 2972. First article positioning member 2972 may be used to enable movement of article positioning system 2970 in a linear direction perpendicular to longitudinal axis 2932. In some embodiments, second article positioning member 2974 may be included. In some cases, first article positioning member 2972 and second article positioning member 2974 may be attached to article positioning shelf 2978. In some other embodiments, article positioning shelf 2978 may be absent, and first article positioning member 2972 and second article positioning member 2974 may be directly attached to linear actuating assembly 2980. In some embodiments, article positioning system 2970 may also include article positioning base 2975. Article positioning base 2975 may be placed directly underneath first article positioning member 2972 and second article positioning member 2974 for increased stability during operation.

In some embodiments, printing system 2900 may also include provisions that allow an article receptacle device such as plank 2922 to move in a lateral direction perpendicular to longitudinal axis 2932 and vertical axis 2952. Referring to FIG. 29, in some embodiments, printing system 2900 may include linear actuating assembly 2980 that can be used to position plank 2922 along lateral axis 2942. Linear actuating assembly 2980 may be similar to linear actuating assembly 2280 described above.

Figure 30:
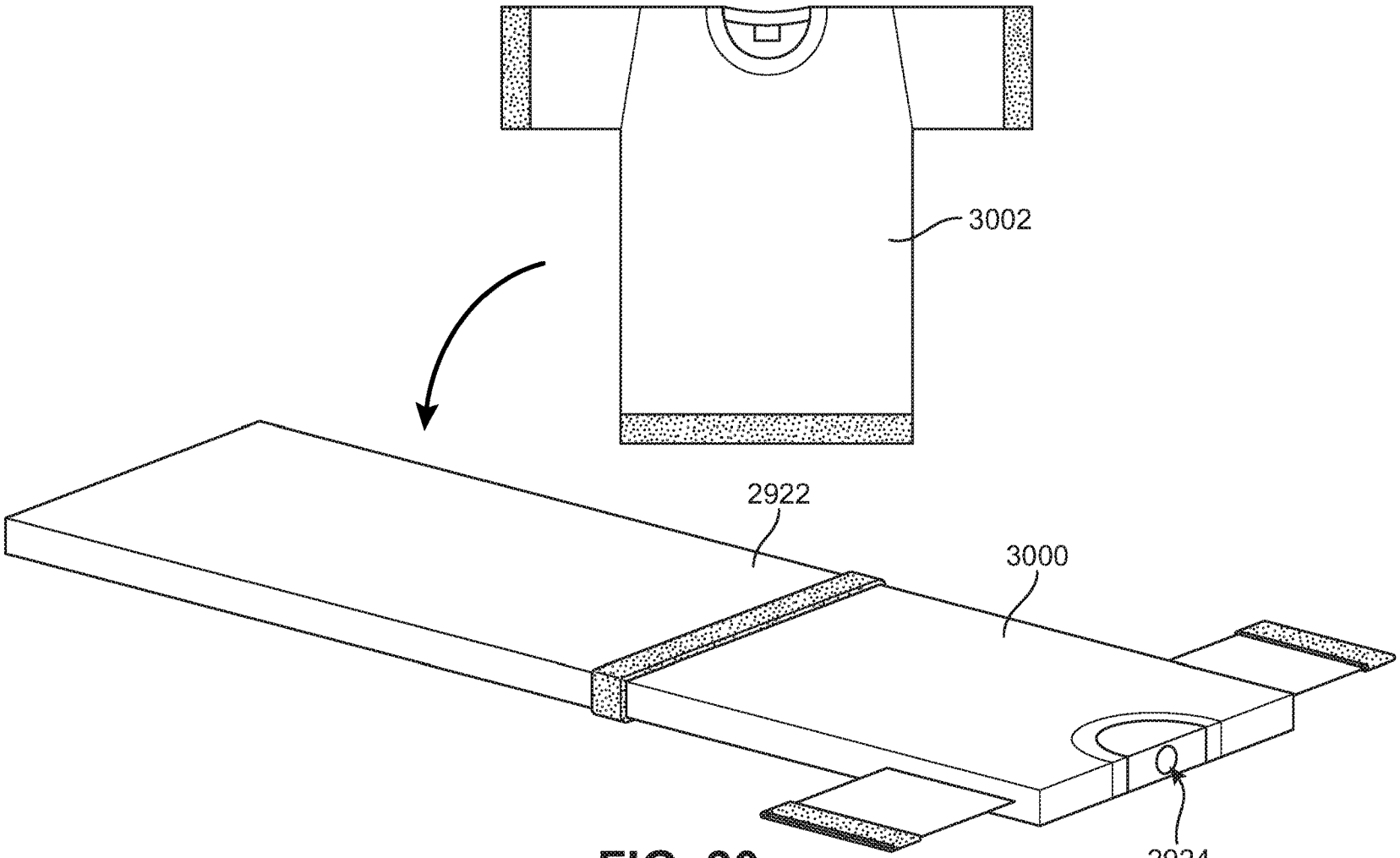
FIGS. 30 and 31 is a schematic view of an article receptacle device being configured with articles of apparel.

Referring to FIG. 30, plank 2922 is shown removed from printing system 2900. As shown, first article 3000 is wrapped around plank 2922. Because plank 2922 is removed from printing system 2900, the large end of first article 3000 may be extended toward a central area of plank 2922. First article 3000 may extend around a portion of plurality of vertical surfaces 2984 as well as first surface 2982 and second surface 2983. Additionally, as shown, the neck opening of first article 3000 may correspond with connecting aperture 2924. By aligning the neck opening of first article 3000 with aperture 2924, plank 2922 may be able to be reattached to vertical support component 2926 by using alignment receiving portion 2928 to engage with connecting aperture 2924.

In some embodiments, plank 2922 may be configured to receive more than one article. As shown in FIG. 30, plank 2922 may be configured to receive second article 3002. As shown, second article 3002 is substantially the same shape and size as first article 3000. In some embodiments, however, second article 3002 may have a different shape or size. For example, in some embodiments, second article 3002 may have a different thickness, or may be in the form of a sweatshirt. Other possibilities for the shape and design of second article 3002 may also be utilized.

Figure 31:
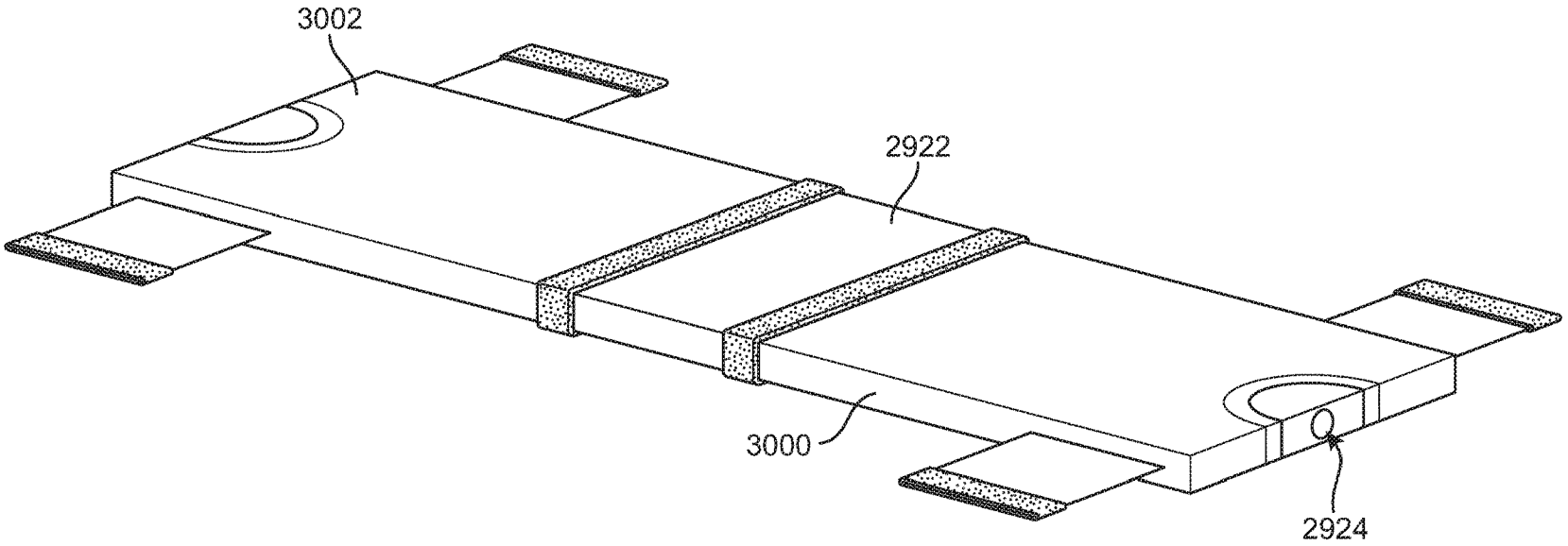

Referring now to FIG. 31, plank 2922 is shown with both first article 3000 and second article 3002 mounted or secured to plank 2922. In some embodiments, either one or both of the articles may not extend around plank 2922. That is, in some embodiments, the articles may be clamped or clipped to plank 2922. For example, in some embodiments, first article 3000 may not extend around plank 2922. Instead, first article 3000 may be placed on first surface 2982 and secured to plank 2922 using a separate securing device such as a clamp. In such embodiments, first article 3000 would not extend around to second surface 2983. In embodiments in which an article does not extend around the surfaces of plank 2922, plank 2922 may not need to be detached from printing system 2900 in order to secure an article to plank 2922. By not removing plank 2922 from system 2900, the time necessary to produce an indicia on a side of an article may be decreased.

In some embodiments, articles on plank 2922 may be spaced from one another. As shown in FIG. 31, a portion of plank 2922 is visible between first article 3000 and second article 3002. In other embodiments, first article 3000 and second article 3002 may overlap each other. In some embodiments, first article 3000 and second article 3002 may abut each other. In such embodiments, a printhead may continuously print from the end of first article 3000 to the end of second article 3002 and decrease the time necessary to print a lower portion of each article.

In some embodiments, a printhead may apply ink or other material along portions of article 3000 that extend over plurality of vertical surfaces 2984. In some embodiments, plank 2922 may rotate about an axis parallel to longitudinal axis 2932 to position a surface such as first vertical surface 2985 to be printed upon. In some embodiments, first article positioning member 2972 and second article positioning member 2974 may be lowered in order to align first vertical surface 2985 with printhead 2930 because only rotating plank 2922 may position first vertical surface 2985 such that the spacing between first vertical surface 2985 is too close, or in some embodiments, plank 2922 and printhead 2930 may interfere with one another.

Figure 32:
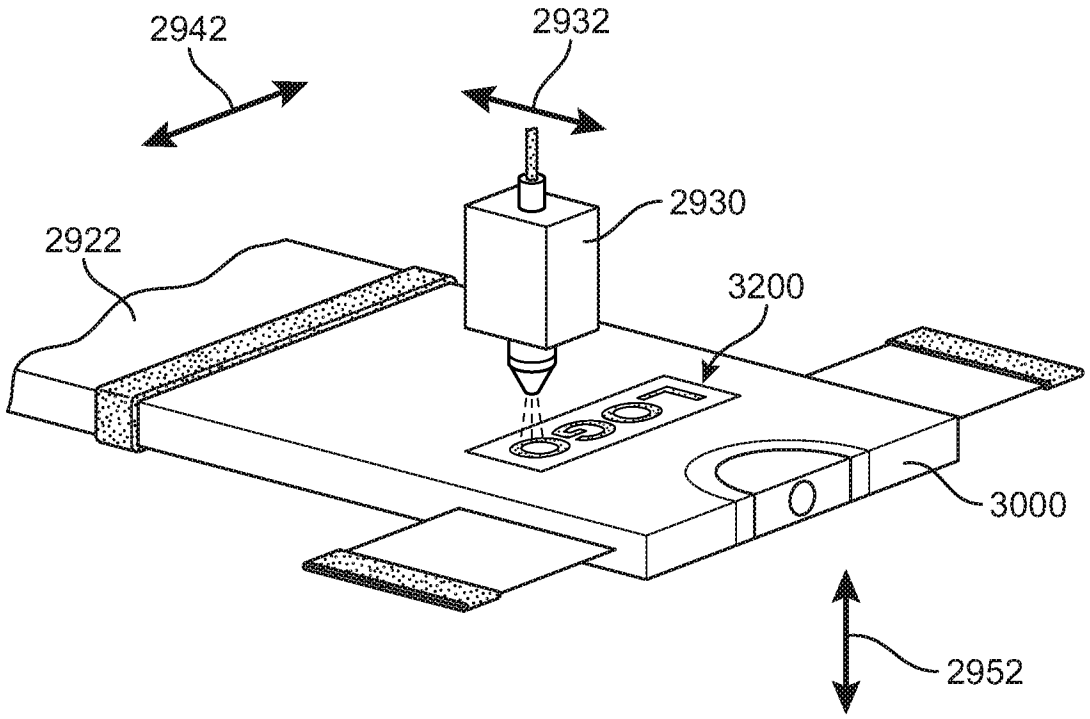
FIG. 32 is a partial schematic close-up view of a printing system printing on an article of apparel using the article receptacle device of FIG. 30.

Referring to FIG. 32, article 3000 and plank 2922 are depicted separately from printing system 2900 for ease of viewing and description. Although shown separately, plank 2922 may be secured to receptacle receiving system 2960 and incorporated into printing system 2900. As shown in FIG. 32, plank 2922 may be able to move along various axes to print an indicia along an area of first article 3000. For example, plank 2922 may be configured to translate along lateral axis 2942 as well as vertical axis 2952 while printhead 2930 may be configured to translate along longitudinal axis 2932. As shown, indicia 3200 is printed laterally along first article 3000. Additionally, indicia 3200 extends longitudinally along first article 3000. Therefore, indicia 3200 may be formed by translating plank 2922 laterally as well as by moving printhead 2930 laterally.

Figure 33:
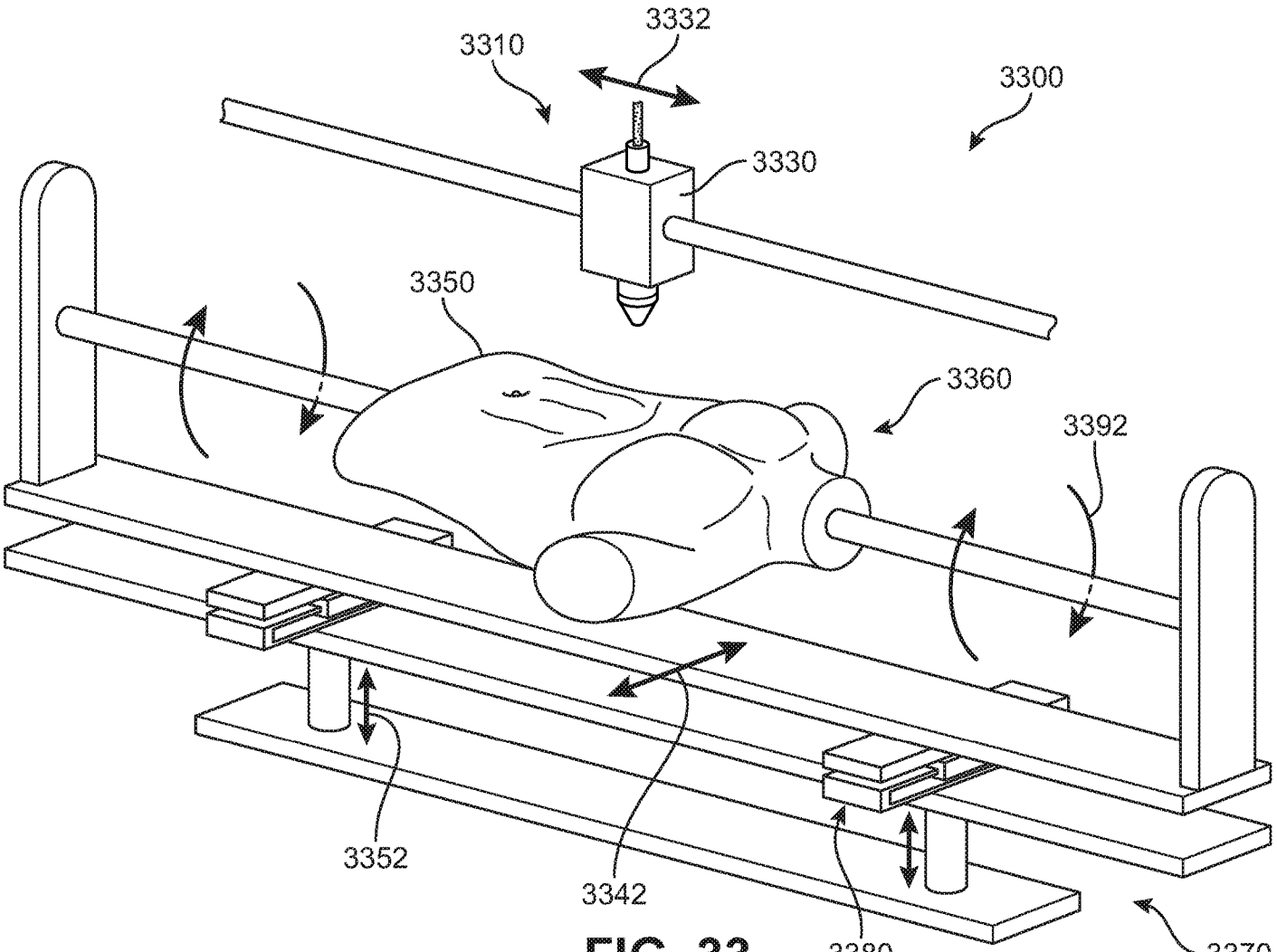
FIG. 33 is schematic view of an embodiment of a printing system with an alternate type of article receptacle device.
Figure 34:
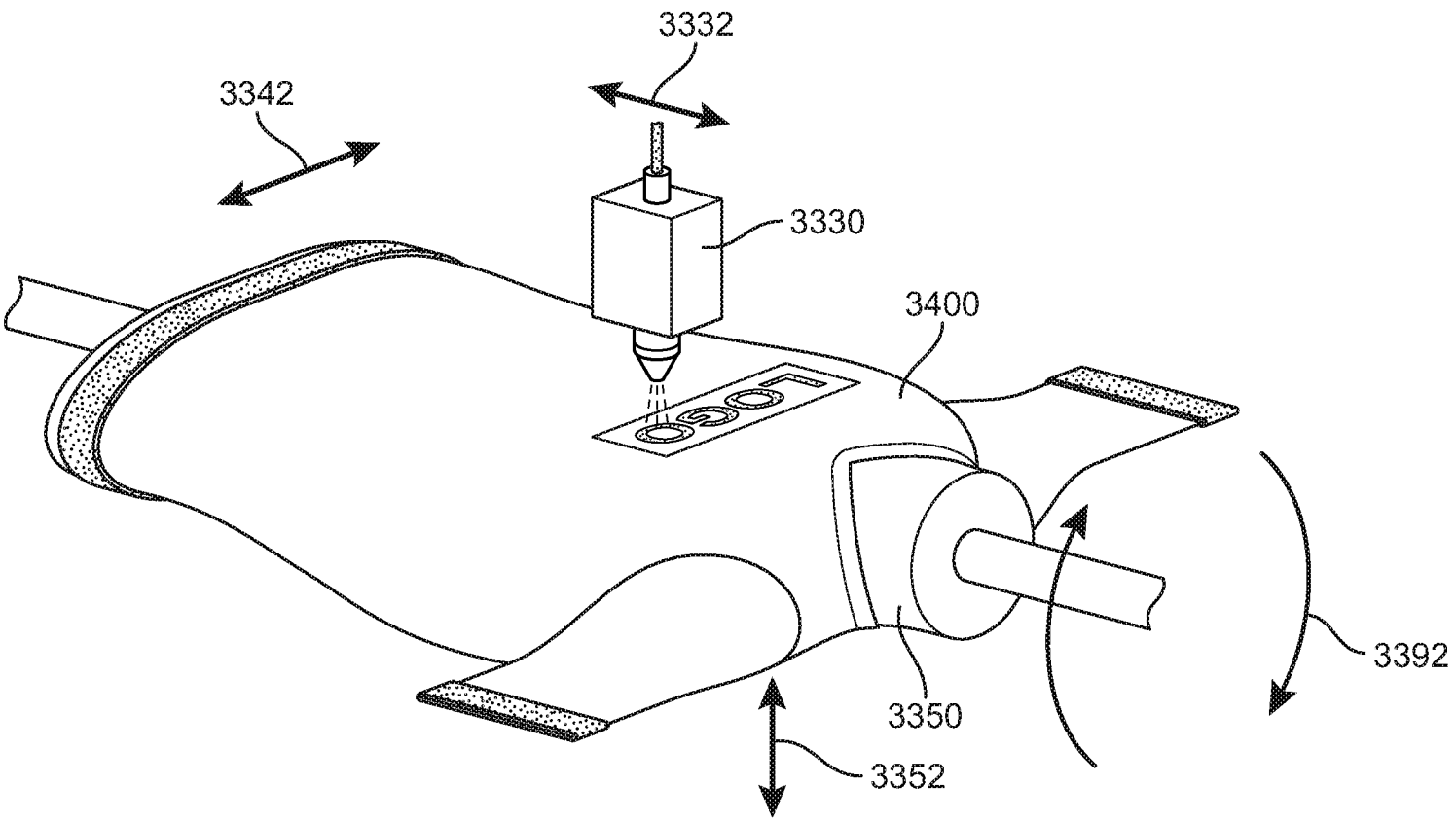
FIG. 34 is a partial schematic close-up view of a printing system printing on an article of apparel using the article receptacle device of FIG. 33.

Referring to FIGS. 33 and 34, an alternate configuration of a printing system is depicted. As shown, printing system 3300 includes many similar subsystems as discussed with reference to other embodiments including printhead assembly 3310, article positioning system 3370, receptacle receiving system 3360, and linear actuating system 3380. Printing system 3300 is configured such that printhead 3330 may translate along longitudinal axis 3332 similar to previous embodiments. Additionally, receptacle receiving system 3360 may be configured to translate along vertical axis 3352 and lateral axis 3342 in a similar manner as discussed with reference to previous embodiments. Further, article receptacle device 3350 may be configured to rotate along rotational direction 3392 about an axis parallel to longitudinal axis 3332.

As shown in FIG. 34, article 3400 may be placed over article receptacle device 3350. As discussed previously with reference to other embodiments, printhead 3330 may translate along longitudinal axis 3332 while article receptacle device 3350 may translate along vertical axis 3352 as well as lateral axis 3342 to facilitate the application of a printable material onto various areas of article 3400. As shown in FIG. 33, article receptacle device 3350 may have contours that may cause various portions of article 3400 to be closer or further away from printhead 3330. In a similar manner as discussed previously, receptacle receiving system 3360 may be angled to provide a constant distance between article 3400 and printhead 3330. The concept of angling or tilting an article receptacle device to provide a constant distance between an article and a printhead may be used with many variously shaped article receptacle devices, and the devices depicted previously in this detailed description are not meant to be limiting.

Referring to FIGS. 35-38, an alternate configuration of a printing system is depicted. As shown, printing system 3500 includes many similar subsystems as discussed with reference to other embodiments including printhead assembly 3510, article positioning system 3570, receptacle receiving system 3560, and linear actuating system 3580. Printing system 3500 is configured such that printhead 3530 may translate along device 3516 along longitudinal axis 3532 similar to previous embodiments. Additionally, receptacle receiving system 3560 may be configured to translate along vertical axis 3552 and lateral axis 3542 in a similar manner as discussed with reference to previous embodiments. Further, article receptacle device 3550 may be configured to rotate along rotational direction 3592 about an axis parallel to longitudinal axis 3532.

Receptacle receiving system 3560 includes vertically oriented receptacle support component 3526 and receptacle support component 3527. In some embodiments, each of the receptacle support components may include alignment components. For example, receptacle support component 3526 includes alignment portion 3528. Alignment portion 3528 may correspond with an opening in article receptacle device 3550. In some embodiments, alignment portion 3528 may attach receptacle device 3550 to receptacle support component 3526.

Figure 35:
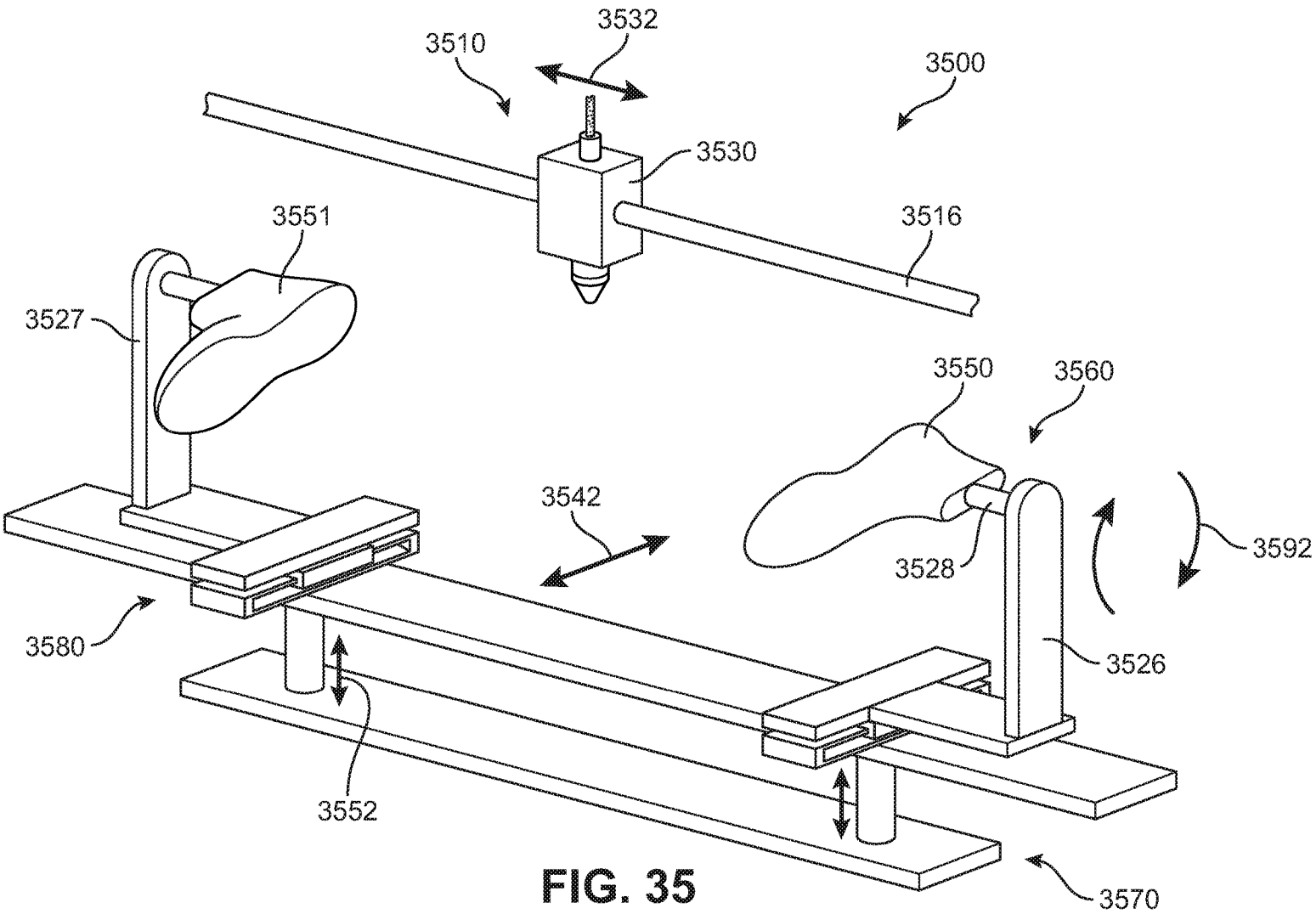
FIG. 35 is a schematic view of an embodiment of a printing system with an embodiment of an article receptacle device.

In some embodiments, the receptacle device may be configured to rotate about an axis. As shown in FIG. 35, article receptacle device 3550 may be configured to rotate along rotational direction 3592. In some embodiments, article receptacle device 3550 and article receptacle device 3551 may be configured to rotate independently of one another. That is, in some embodiments, article receptacle device 3550 may rotate along rotational direction 3592 while article receptacle device 3551 does not rotate or rotates at a different rate.

In different embodiments, different provisions can be used to rotate one or more receptacle devices. In some embodiments, a belt may be used to rotate alignment portion 3528. In other embodiments, an arrangement of gears may be used to rotate alignment portion 3528. In some embodiments, a computer system may be used to control the rotation of alignment portion 3598. The computer system may be connected to a motor to rotate alignment portion 3598. In other embodiments, alignment portion 3528 and article receptacle device 3550 may be rotated manually.

Figure 36:
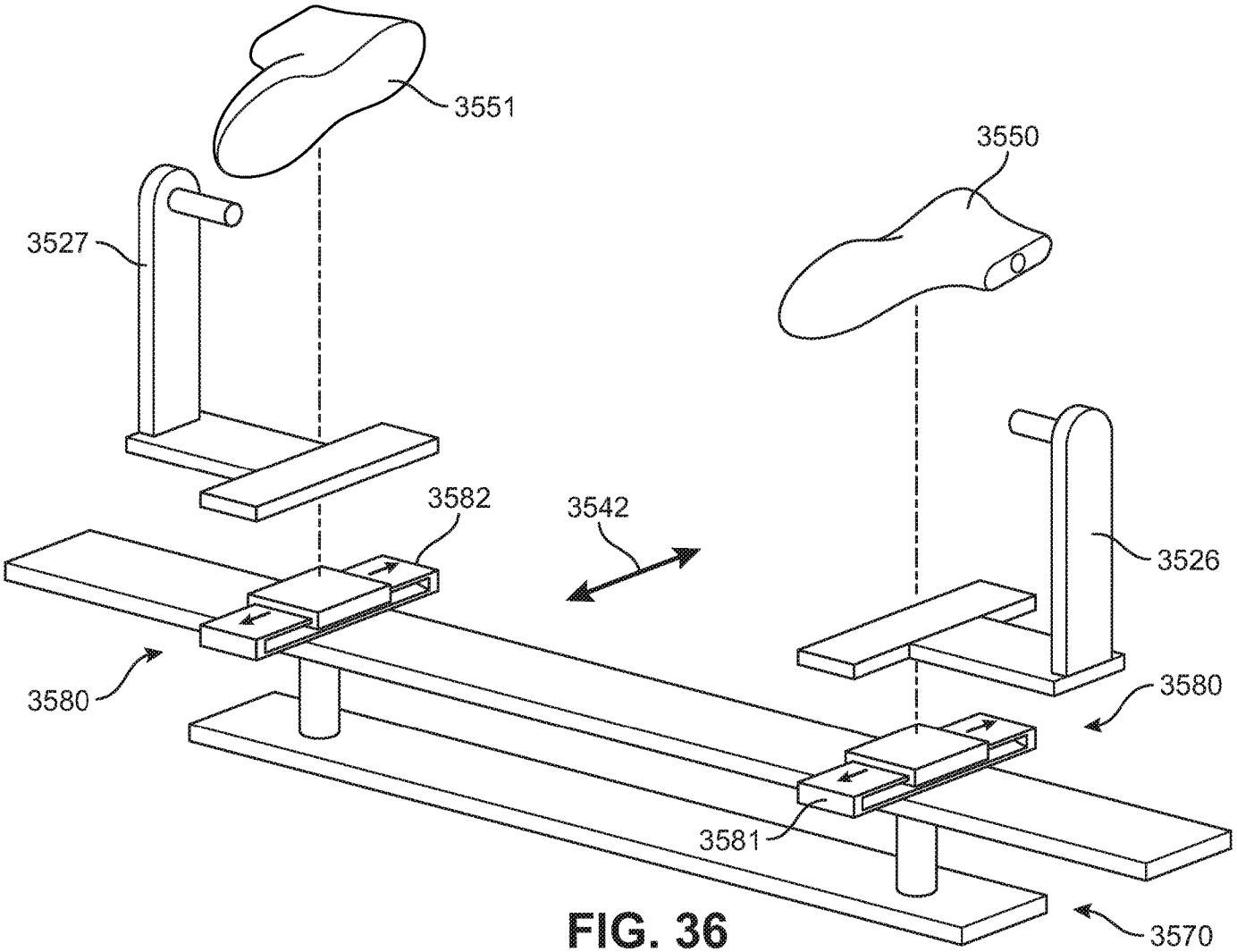
FIG. 36 is a partial exploded view of an embodiment of the printing system of FIG. 35.

FIG. 36 illustrates a partial exploded view of some of the components of printing system 3500 as shown in FIG. 35. Some embodiments may have different configurations and shapes for an article receptacle device, depending on the type of article to be secured. As shown in FIG. 36, article receptacle device 3550 is shaped as a last or similar to an article of footwear. Other designs or shapes such as pant legs, torsos, or other shapes may also be used for an article receptacle device.

As shown in FIG. 36, receptacle support component 3526 and receptacle support component 3527 may be configured to translate independently of one another. In some embodiments, receptacle support component 3526 and receptacle support component 3527 may be separate or distinct pieces from one another. In other embodiments, receptacle support component 3526 and receptacle support component 3527 may be attached to one another. As shown in FIG. 36, receptacle support component 3526 and receptacle support component 3527 are separate from each other. In this configuration, receptacle support component 3526 may be secured to linear actuator 3581 while receptacle support component 3527 may be secured to linear actuator 3582. In this configuration, therefore, receptacle support component 3527 and receptacle support component 3526 may move independently from one another along lateral axis 3542.

Figure 37:
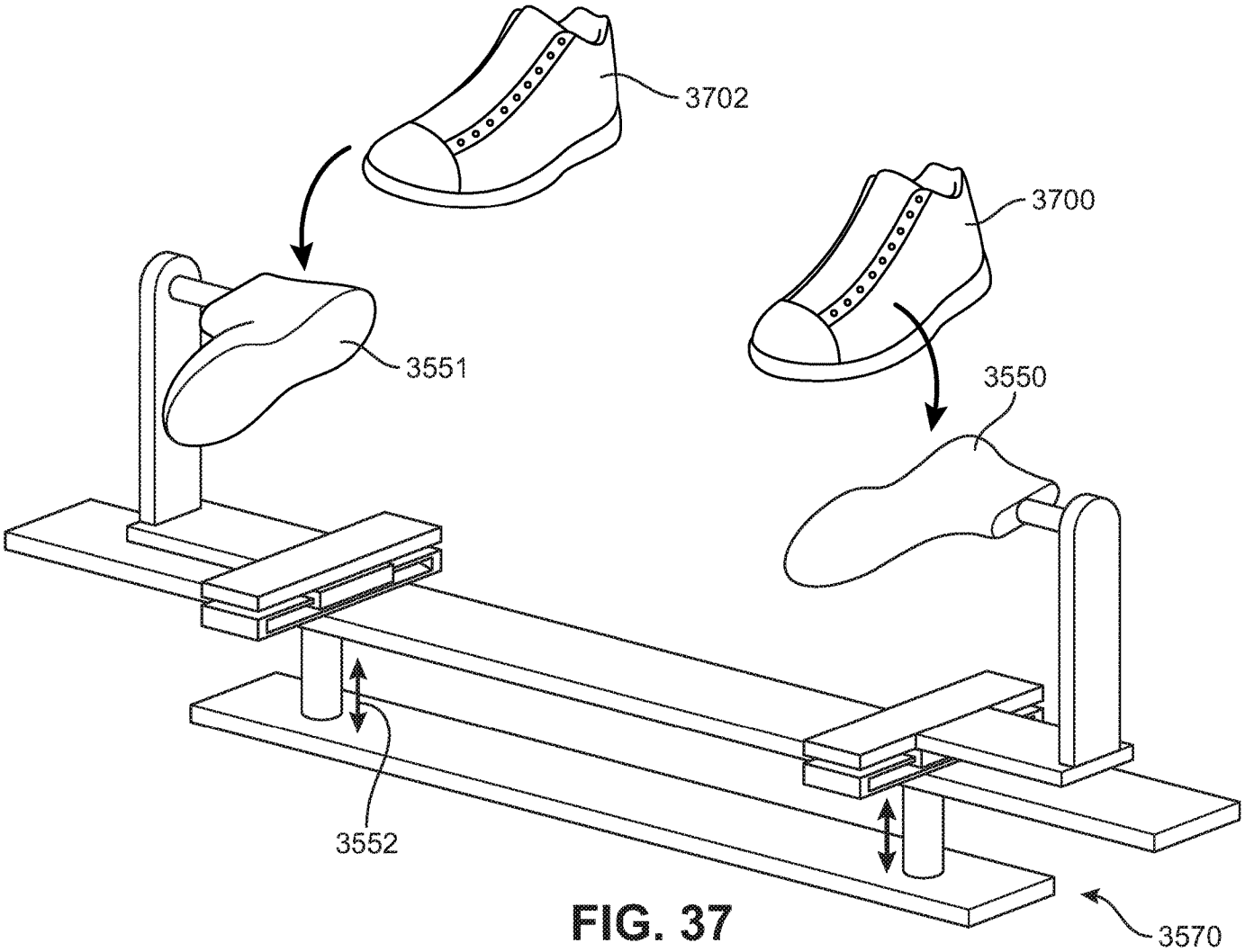
FIG. 37 is a schematic view of an embodiment of a printing system with an article of apparel.

Referring to FIG. 37, article 3700 and article 3702 are placed on an article receptacle device. In particular, article 3700 may be placed on article receptacle device 3550 while article 3702 may be placed on article receptacle device 3551. Article 3700 may be secured using various provisions including strapping, buttoning, or other physical restraints. In some embodiments, article receptacle device 3550 may be inserted into article 3700 without additional securement features to hold article 3700 on article receptacle device 3550.

Figure 38:
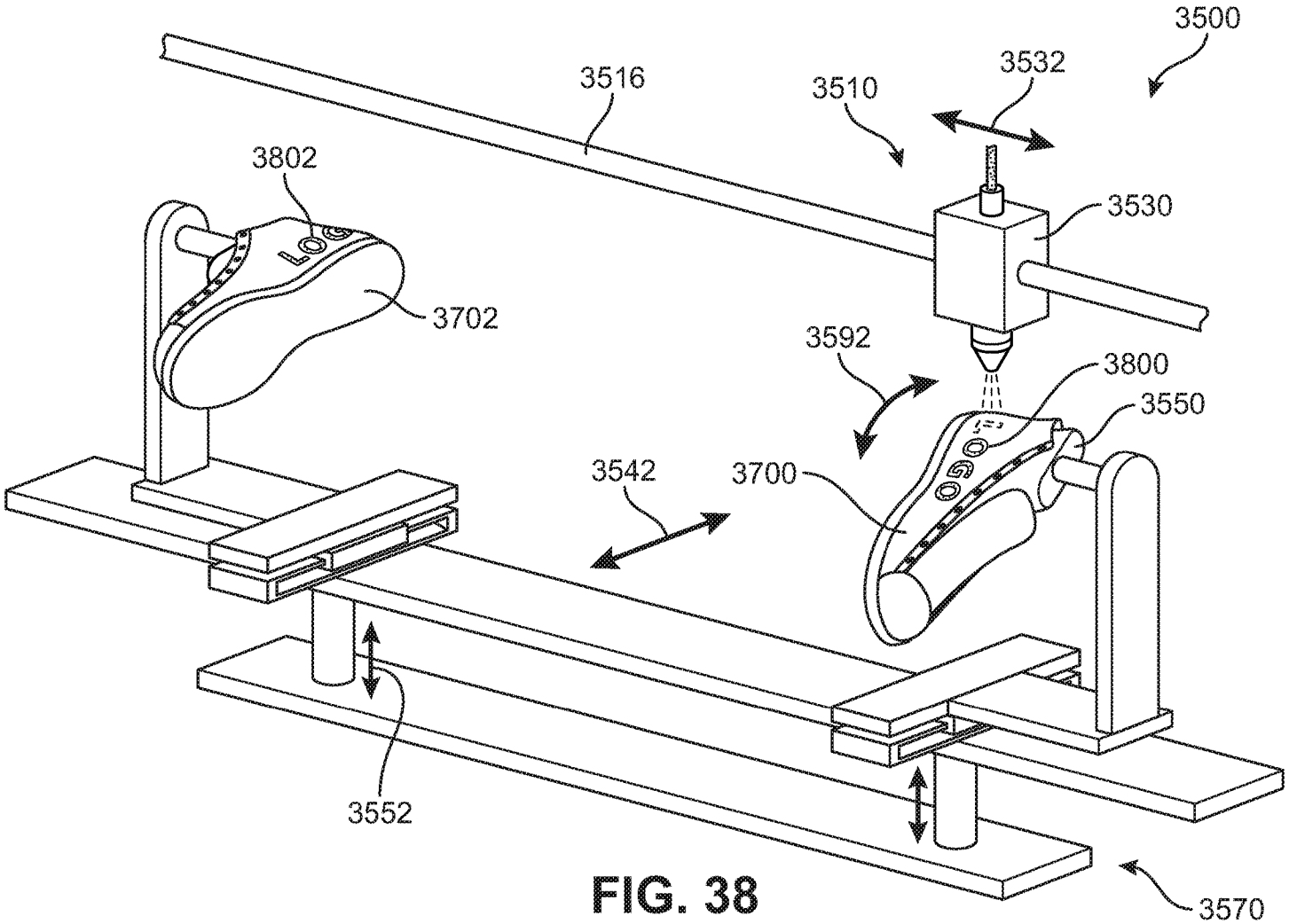
FIG. 38 is a schematic view of an embodiment of a printing system configured with an article of apparel.

Referring now to FIG. 38, components of printing system 3500 may be used to print on an article. As shown, printhead assembly 3510 may translate along rail 3516 and move between article 3700 and article 3702. As shown in FIG. 38, article 3702 has a completed printed portion 3802 while printed portion 3800 of article 3700 has not yet been completed.

In some embodiments, a printed portion may be formed along various portions of an article. In some embodiments, the printed portion may be formed continuously. As shown in FIG. 38, article receptacle device 3550 may be rotated about rotational direction 3592. As article 3700 rotates, printhead 3530 may deposit a print material onto article 3700. Further, article 3700 may translate along lateral direction 3542, and printhead assembly 3510 may translate along longitudinal direction 3532. Therefore, print material may be deposited on a lateral side, a medial side, on a heel or other areas of article 3700 without the necessity of removing article 3700 from article receptacle device 3550. The continuous or uninterrupted depositing of print material onto article 3700 may increase the efficiency in which printed portions are formed on an article by decreasing the time necessary to form each printed portion. Additionally, the quality of the printed portion may increase as the article does not need to be removed in order to form printed portions on various areas of the article.

In some embodiments, multiple print assemblies may be used during the printing process. For example, a second print assembly may be used that may print upon article 3702. By utilizing two print assemblies, the printing time necessary to complete a printed portion on a pair of articles may be decreased.

Figure 39:
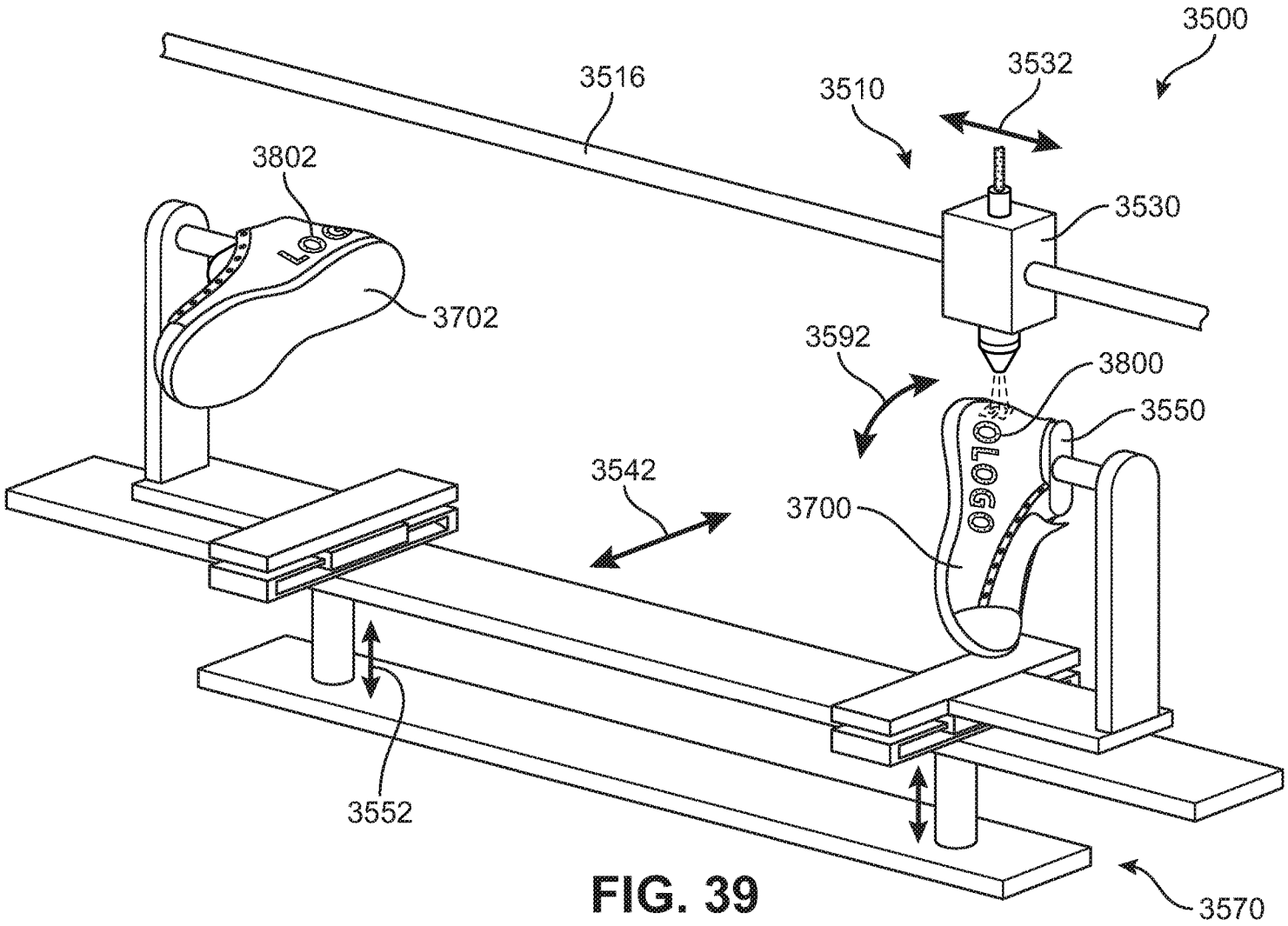
FIG. 39 is a schematic view an embodiment of a printing system configured with an article of apparel.

Referring to FIG. 39, article receptacle device 3550 may be rotated to a greater degree than depicted in FIG. 38. In this position, article receptacle device 3550 is rotated such that the heel region of article 3700 is oriented toward printhead 3530. In this embodiment, printed portion 3800 is being formed along a heel of article 3700. As shown, printed portion 3800 may be formed continuously from a forefoot lateral side, to a heel region and then to a forefoot medial side. Print system 3500 may rotate article 3700, or print system 3500 may move article 3700 along lateral direction 3542 or vertical direction 3552 in order to print along various portions of article 3700. Further, print assembly 3510 may also translate along longitudinal direction 3532 to print along various portions of article 3700.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A printing system, comprising:

an article receptacle device that includes a surface that can receive an article of apparel;

a receptacle receiving system that receives the article receptacle device;

a linear actuating assembly configured to move the receptacle receiving system along a lateral axis;

an article positioning system comprising a first positioning member and a second positioning member, the article positioning system being configured to move the article receptacle device between a horizontal configuration and a tilted configuration;

a printhead displaceable along a longitudinal axis and facing at least a portion of the surface of the article receptacle device;

wherein the article receptacle device has a first receptacle end and a second receptacle end;

wherein the first receptacle end and the second receptacle end have a same vertical position along a vertical axis in the horizontal configuration, the vertical axis being perpendicular to the longitudinal axis;

wherein the first receptacle end and the second receptacle end have different vertical positions along the vertical axis in the tilted configuration;

wherein the linear actuating assembly is configured to move the article receptacle device along the lateral axis, the lateral axis being perpendicular to the vertical axis and the longitudinal axis; and wherein the first and second positioning members are spaced apart along the longitudinal axis and are independently moveable relative to one another along the vertical axis.

2. The printing system according to claim 1, wherein the article positioning system includes a first article positioning member, the first article positioning member being configured to extend along the vertical axis.

3. The printing system according to claim 2, wherein the article positioning system includes a second article positioning member, the second article positioning member being configured to extend along the vertical axis, and wherein the first article positioning member is configured to move independently from the second article positioning member.

4. The printing system according to claim 1, wherein the article receptacle device can be removed from the receptacle receiving system.

5. The printing system according to claim 1, wherein the article receptacle device is configured to receive at least two articles of apparel.

6. The printing system according to claim 1, wherein the linear actuating assembly comprises a carriage, the carriage being secured to a portion of the receptacle receiving system.

7. The printing system according to claim 1, wherein the receptacle receiving system allows the article receptacle device to be rotated about a central axis of the article receptacle device.

8. The printing system according to claim 1, wherein the article receptacle device is a platen.

* * * * *